US008565623B2

(12) United States Patent
Itabashi

(10) Patent No.: US 8,565,623 B2
(45) Date of Patent: Oct. 22, 2013

(54) IMAGE FORMING DEVICE THAT HAS SUPPORT MEMBER HAVING COVER MEMBER

(75) Inventor: Nao Itabashi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 280 days.

(21) Appl. No.: 13/074,408

(22) Filed: Mar. 29, 2011

(65) Prior Publication Data

US 2012/0027422 A1 Feb. 2, 2012

(30) Foreign Application Priority Data

Aug. 2, 2010 (JP) ..... 2010-173514

(51) Int. Cl.
*G03G 15/00* (2006.01)

(52) U.S. Cl.
USPC ..... 399/12

(58) Field of Classification Search
USPC ..... 399/12, 107, 24
See application file for complete search history.

(56) References Cited

U.S. PATENT DOCUMENTS

| | | | |
|---|---|---|---|
| 6,115,571 | A | 9/2000 | Kobayashi |
| 6,185,401 | B1 | 2/2001 | Kanamori et al. |
| 6,944,415 | B2 | 9/2005 | Nomura |
| 7,711,311 | B2 | 5/2010 | Watanabe et al. |
| 7,751,729 | B2 | 7/2010 | Watanabe et al. |
| 7,778,567 | B2 | 8/2010 | Igarashi et al. |
| 7,869,720 | B2 | 1/2011 | Watanabe et al. |
| 8,078,085 | B2 | 12/2011 | Okabe |
| 8,107,829 | B2 | 1/2012 | Sato et al. |
| 2006/0067734 | A1 | 3/2006 | Igarashi et al. |
| 2008/0025758 | A1 | 1/2008 | Sato |
| 2008/0166139 | A1 | 7/2008 | Watanabe et al. |
| 2008/0166141 | A1 | 7/2008 | Watanabe et al. |
| 2008/0166145 | A1 | 7/2008 | Watanabe et al. |
| 2008/0226341 | A1 | 9/2008 | Mase et al. |
| 2008/0260422 | A1 | 10/2008 | Sasae et al. |
| 2009/0142079 | A1 | 6/2009 | Sato et al. |
| 2009/0190953 | A1 | 7/2009 | Okabe |

(Continued)

FOREIGN PATENT DOCUMENTS

| | | | |
|---|---|---|---|
| CN | 1167279 | A | 12/1997 |
| CN | 1550928 | A | 12/2004 |

(Continued)

OTHER PUBLICATIONS

Related U.S. Appl. No. 13/086,631, filed Apr. 14, 2011.

(Continued)

*Primary Examiner* — Quana M Grainger
(74) *Attorney, Agent, or Firm* — Banner & Witcoff, Ltd.

(57) ABSTRACT

An image forming device includes a support member movable between an accommodated position within a main casing and a pulled-out position outside the main casing, developing units, toner cartridges, and a cover member. Each toner cartridge includes a casing and a shutter. The casing accommodates toner therein and is formed with an opening for supplying the toner to the corresponding developing unit. The opening faces in a first direction when the toner cartridge is accommodated in a corresponding cartridge accommodating section in the support member. The shutter is movable between an opening position for exposing the opening and a closing position for closing the opening. The cover member is movable between an opening posture for exposing a first side of the corresponding cartridge accommodating section in the first direction and a closing posture for opposing the first side of the corresponding cartridge accommodating section.

11 Claims, 26 Drawing Sheets

(56) References Cited

U.S. PATENT DOCUMENTS

| | | | |
|---|---|---|---|
| 2010/0074646 | A1 | 3/2010 | Miyahara et al. |
| 2010/0111562 | A1 | 5/2010 | Okabe et al. |
| 2011/0280630 | A1 | 11/2011 | Itabashi |

FOREIGN PATENT DOCUMENTS

| | | | |
|---|---|---|---|
| CN | 1755555 | A | 4/2006 |
| JP | H03-077941 | U | 8/1991 |
| JP | H04-296885 | A | 10/1992 |
| JP | H05-043389 | U | 6/1993 |
| JP | H06-130867 | A | 5/1994 |
| JP | H07-271250 | A | 10/1995 |
| JP | H08-054817 | A | 2/1996 |
| JP | 2003-107892 | A | 4/2003 |
| JP | 2004-258230 | A | 9/2004 |
| JP | 2005-326869 | A | 11/2005 |
| JP | 2006-098772 | | 4/2006 |
| JP | 2006-098776 | A | 4/2006 |
| JP | 2008-026830 | | 2/2008 |
| JP | 2008-170622 | A | 7/2008 |
| JP | 2009-139489 | A | 6/2009 |
| JP | 2009-175416 | A | 8/2009 |
| JP | 2010-078848 | A | 4/2010 |
| JP | 2010-107890 | A | 5/2010 |
| JP | 2011-242553 | A | 12/2011 |

OTHER PUBLICATIONS

US Office Action mailed Dec. 18, 2012, U.S. Appl. No. 13/086,631.

CN First Office Action dtd Oct. 16, 2012, CN Appln. 201110146723.9, English translation.

JP Office Action mailed Jul. 3, 2012, JP Appln. 2010-173514.

IMAGE FORMING DEVICE THAT HAS SUPPORT MEMBER HAVING COVER MEMBER

CROSS REFERENCE TO RELATED APPLICATION

This application claims priority from Japanese Patent Application No. 2010-173514 filed Aug. 2, 2010. The entire content of this priority application is incorporated herein by reference.

TECHNICAL FIELD

The present invention relates to an image forming device, such as a laser printer.

BACKGROUND

There has been provided a tandem type color printer having four photosensitive drums integrally detachable from a main casing and corresponding to each of four colors yellow, magenta, cyan, and black.

In this type of color printer, a frame is provided in the main casing such that the frame can be pulled out from the main casing in a horizontal direction, for example. The four photosensitive drums are supported on the frame and juxtaposed with one another in a pull-out direction of the frame. Developing cartridges corresponding to the photosensitive drums are detachably mounted onto the frame from above. Each developing cartridge has a developing roller and accommodates toner therein. When any of the developing cartridges runs out of toner, then the frame is pulled out of the main casing, and the developing cartridge is detached from the frame, and a new developing cartridge is mounted onto the frame.

Printer manufactures and the like have recently been urged to meet demand for cost reductions and environmental concerns. In terms of cost reductions and environmental concerns, it is desirable to employ a toner cartridge replacing system, in which only a toner cartridge for accommodating toner is replaced without replacing the developing roller, rather than to replace the entire developing cartridge, when toner runs out.

SUMMARY

When the toner cartridge replacing system is employed, however, a section of the frame for accommodating the toner cartridge may be smeared with ink, making the frame look dirty. Also, when the toner cartridge formed with a toner supply hole facing downward is used, a frame formed with a toner inlet opening that is facing upward is used. Thus, there is a danger that foreign matter may enter a developing unit having a developing roller, through the toner inlet opening.

In view of the foregoing, it is an object of the invention to provide an image forming device having a configuration that can make a support member look better and that can prevent foreign matter other than toner from entering a developing unit.

In order to attain the above and other objects, the invention provides an image forming device including a main casing, a support member, a plurality of developing units, a plurality of toner cartridges, and a cover member. The support member is movable between an accommodated position within the main casing and a pulled-out position outside the main casing, and is formed with a plurality of cartridge accommodating sections, each of which has a first side and a second side one a downstream side of the first side with respect to a first direction. The plurality of developing units is supported on the support member and corresponding to the plurality of cartridge accommodating sections. Each of the toner cartridges is accommodated in the corresponding cartridge accommodating section so as to be detachable from the corresponding cartridge accommodating section when the support member is located at the pulled-out position, and includes a casing and a shutter. The casing accommodates toner therein and is formed with an opening for supplying the toner to the corresponding developing unit. The opening faces in the first direction in a condition that the toner cartridge is accommodated in the corresponding cartridge accommodating section. The shutter is movable between an opening position at which the shutter exposes the opening and a closing position at which the shutter closes the opening. The cover member is movable between an opening posture in which the cover member exposes the first side of the corresponding cartridge accommodating section and a closing posture in which the cover member opposes the first side of the corresponding cartridge accommodating section.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
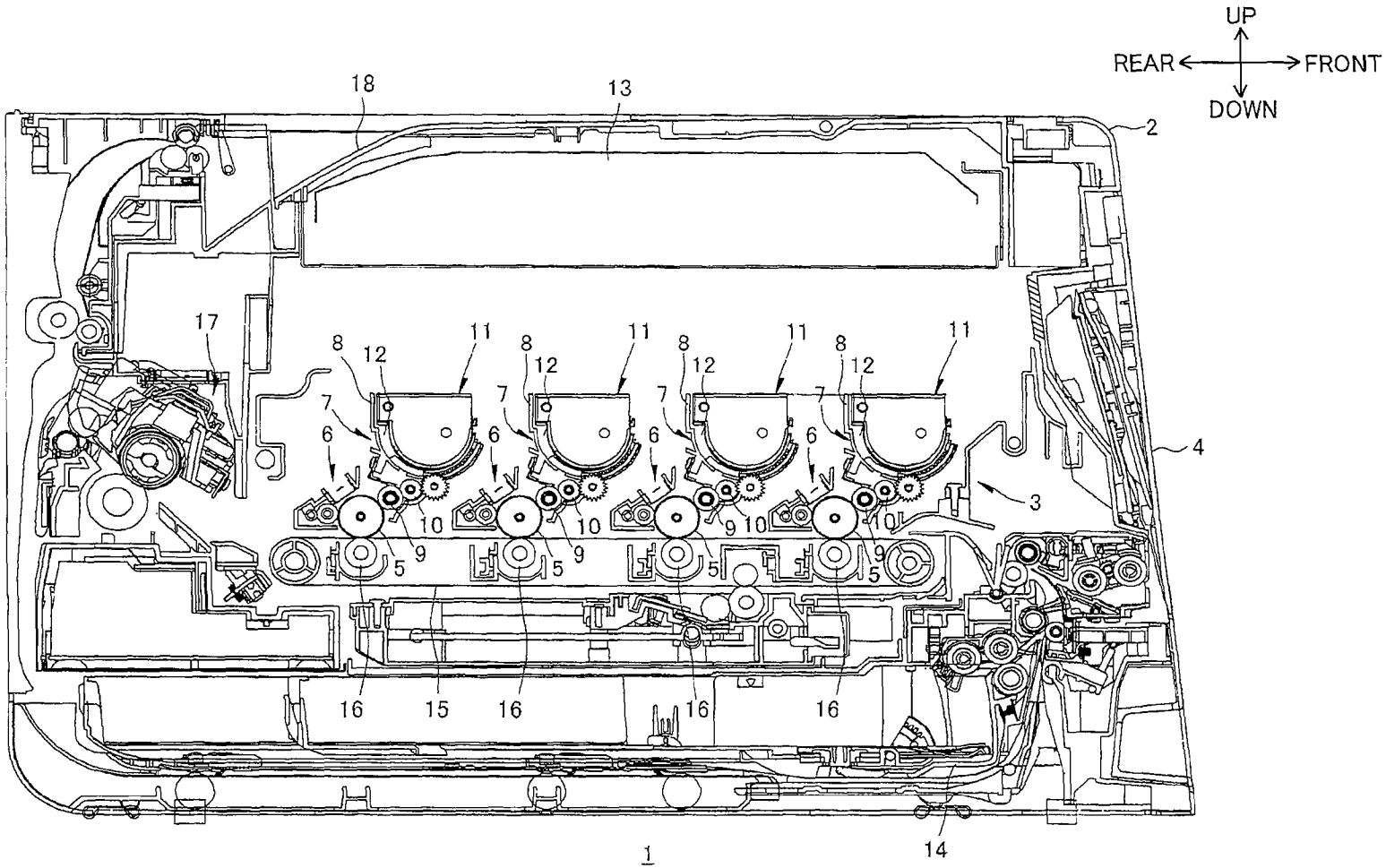
FIG. 1 is a cross-sectional left side view of a color printer according to a first embodiment of the invention.

Image forming devices according to embodiments of the invention will be described while referring to the accompanying drawings wherein like parts and components are designated by the same reference numerals to avoid duplicating description.

First, a color printer 1 as an image forming device according to a first embodiment of the invention will be described while referring to FIGS. 1 to FIG. 8.

Figure 2:
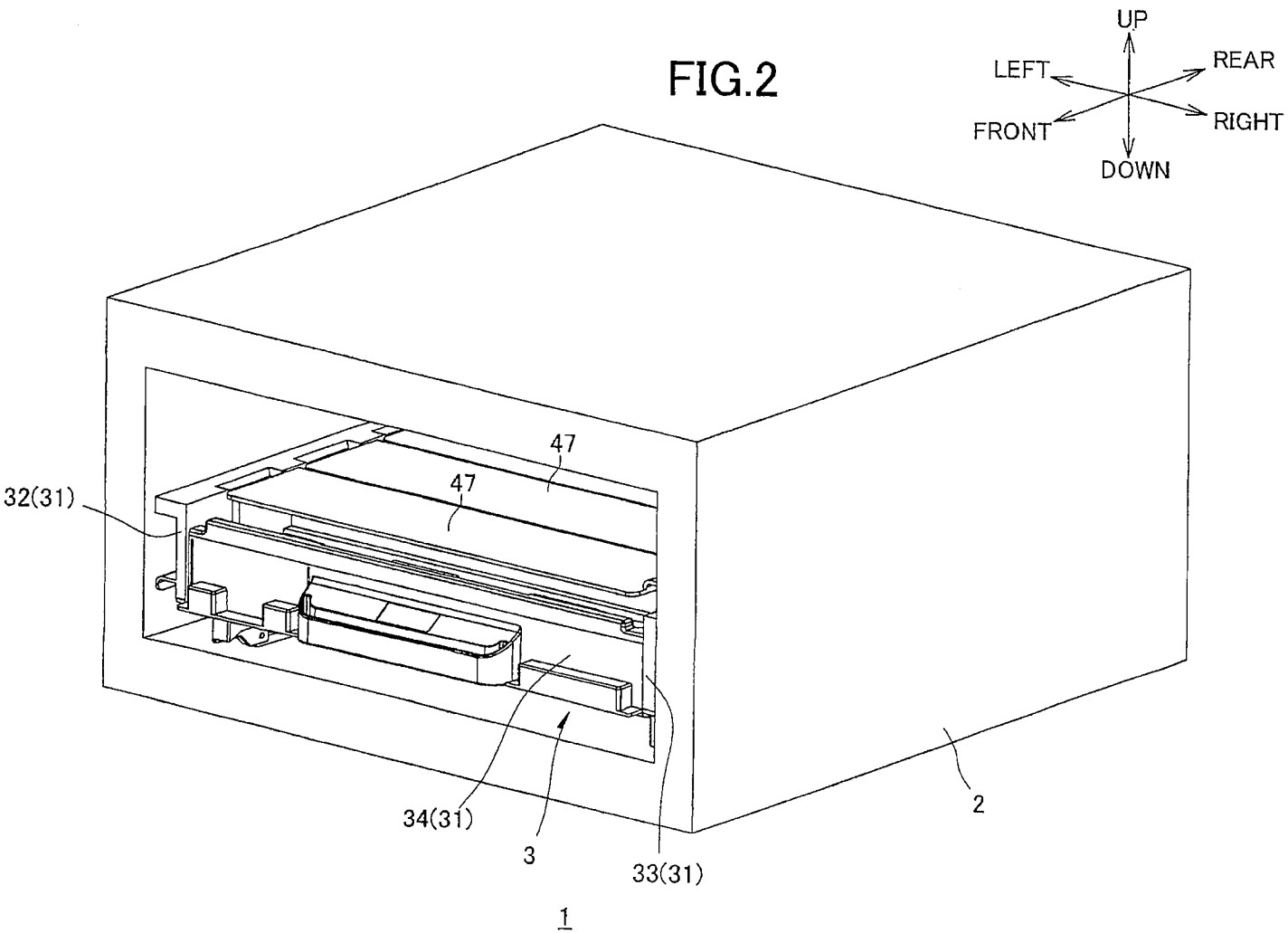
FIG. 2 is a perspective view of the color printer of FIG. 1, with a drawer unit at an accommodated position.
Figure 3:
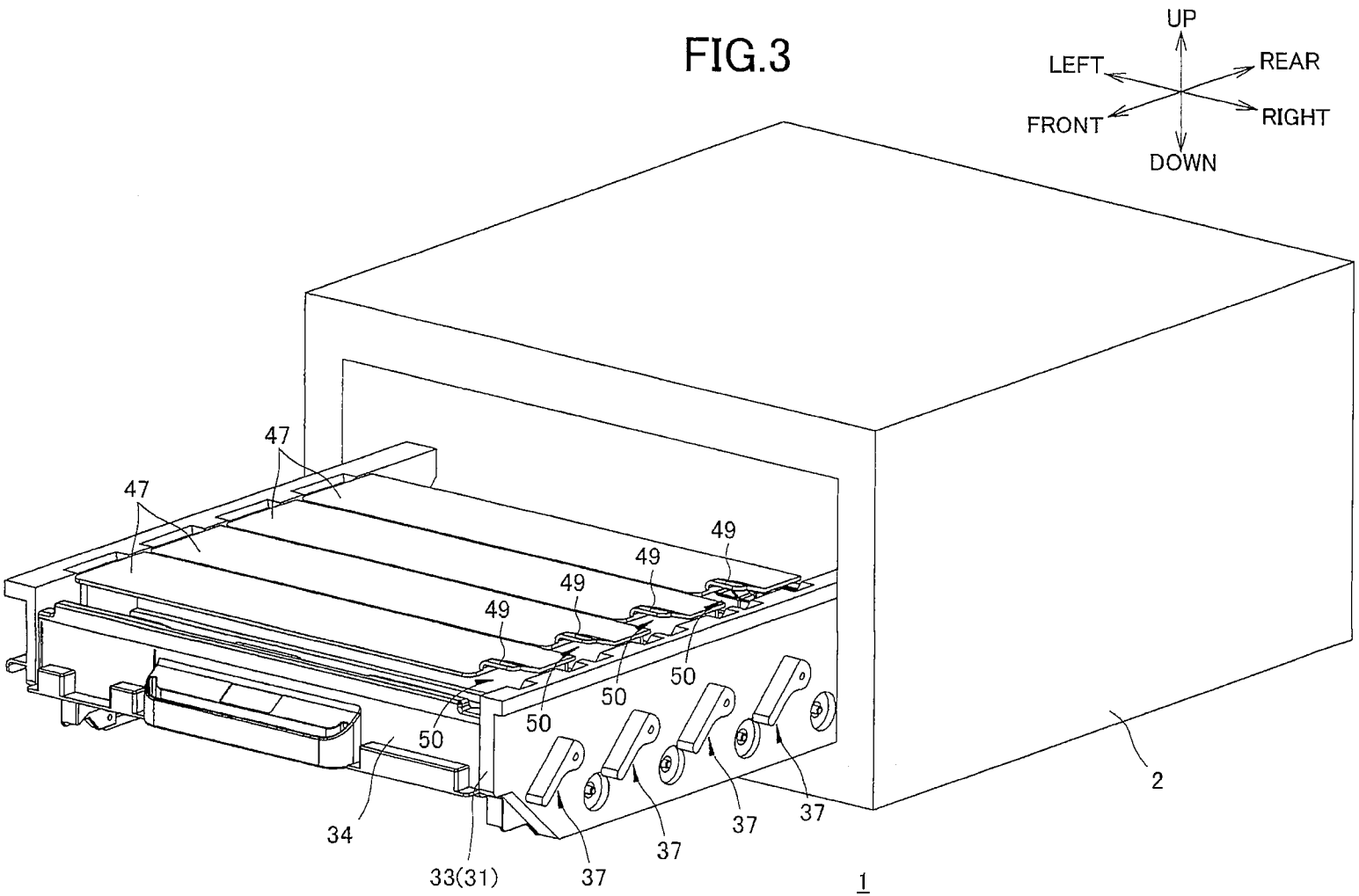
FIG. 3 is a perspective view of the color printer of FIG. 1, with the drawer unit at a pulled-out position.

As shown in FIG. 1, the color printer 1 is a tandem type color printer. As shown in FIGS. 1 to 3, the color printer 1 includes a main casing 2 that accommodates a drawer unit (tandem type process unit) 3. The main casing 2 is provided with a front cover 4 that can be selectively opened and closed. The drawer unit 3 can move in a front-rear direction (horizontal direction) relative to the main casing 2 between an accommodated position within the main casing 2 (FIG. 2) and a pulled-out position outside the main casing 2 (FIG. 3), when the front cover 4 is open.

Note that the terms "upward," "downward," "upper," "lower," "above," "below," "right," "left," "front," "rear," and the like will be used throughout the description assuming that the color printer 1 is disposed in an orientation in which it is intended to be used and that the drawer unit 3 and toner cartridges 11 (described later) mounted thereon are accommodated in the main casing 2, unless defined otherwise. In use, the color printer 1 is disposed as shown in FIG. 1. The left and right sides of the main casing 2 will be based on the perspective of a user looking at the color printer 1 from the front side. The front cover 4 is omitted in FIGS. 2 and 3.

The drawer unit 3 includes a drawer frame 31, four photosensitive drums (image bearing members) 5, four chargers 6 corresponding to the photosensitive drums 5, and four developing units 7 corresponding to the photosensitive drums 5.

As shown in FIG. 1, the drawer unit 3 (the drawer frame 31) supports the four photosensitive drums 5 such that the photosensitive drums 5 can rotate about respective rotary shafts extending along a right-left direction. The four photosensitive drums 5 are provided for respective colors black (K), yellow (Y), magenta (M), and cyan (C), and are aligned at fixed intervals in the front-rear direction. The order of the photosensitive drums 5 arranged from front to rear in this embodiment are those for colors black, yellow, magenta, and cyan.

The drawer unit 3 (the drawer frame 31) also supports the four chargers 6 and the four developing units 7. The chargers 6 are disposed diagonally rearward and upward of the respective photosensitive drums 5. Each charger 6 is a Scorotron charger including a wire and a grid. The developing units 7 are disposed diagonally frontward and upward of the respective photosensitive drums 5.

Each developing unit 7 includes a developing frame 8 that supports both a developing roller 9 and a supply roller 10.

The developing roller 9 is rotatable about a rotary shaft extending in the right-left direction and is disposed to contact the corresponding photosensitive drum 5.

The supply roller 10 is rotatable about a rotary shaft extending in the right-left direction and is disposed to contact an upper front section of the developing roller 9.

Four spaces (toner cartridge accommodating sections) 12 for accommodating the respective toner cartridges 11 are defined within the drawer unit 3 at positions above the developing units 7. The toner cartridges 11 are accommodated into the corresponding spaces 12 from above when the drawer unit 3 is at the pulled-out position. The toner cartridge 11 accommodates toner therein and supplies the toner to the corresponding developing unit 7.

The color printer 1 also includes an exposing unit 13 accommodated in the main casing 2 at a position above the drawer unit 3. The exposing unit 13 irradiates four laser beams corresponding to each color.

A surface of each photosensitive drum 5 is uniformly charged by a discharge from the corresponding charger 6 as the photosensitive drum 5 rotates, and is then selectively exposed to the laser beam from the exposing unit 13. As a result, an electric potential on the surface of the photosensitive drum 5 is selectively lowered, thereby forming an electrostatic latent image on the surface of the photosensitive drum 5. When the electrostatic latent image is brought into confrontation with the corresponding developing roller 9, toner is selectively supplied onto the electrostatic latent image. As a result, a toner image is formed on the surface of the photosensitive drum 5.

Note that the color printer 1 may include four LED arrays, instead of the exposing unit 13.

The color printer 1 further includes a sheet supply cassette 14, a convey belt 15, four transfer rollers 16, and a fixing unit 17. The sheet supply cassette 14 is for accommodating paper sheets P and disposed in the bottom of the main casing 2. The paper sheets P accommodated in the sheet supply cassette 14 are conveyed one at a time onto the convey belt 15 by various rollers. The convey belt 15 is disposed below and opposite to the four photosensitive drums 5. The transfer rollers 16 are disposed in confrontation with the respective photosensitive drums 5 with an upper section of the convey belt 15 interposed therebetween. The paper sheet P conveyed onto the convey belt 15 is conveyed rearward by rotation of the convey belt 15 to pass through positions between the convey belt 15 and each photosensitive drum 5 in sequence. The toner image formed on the surface of each photosensitive drum 5 is transferred onto the paper sheet P when brought into confrontation therewith.

The fixing unit 17 is disposed on a downstream side of the convey belt 15 with respect to a sheet convey direction in which the paper sheet P is conveyed. The paper sheet P with toner images transferred thereon is conveyed to the fixing unit 17. The fixing unit 17 fixes the toner images onto the paper sheet P by heat and pressure. The paper sheet P with the toner images fixed thereon is discharged by various rollers onto a discharge tray 18 formed on an upper surface of the main casing 2.

Note that the discharge tray 18 is omitted in FIGS. 2 and 3.

Figure 4A:
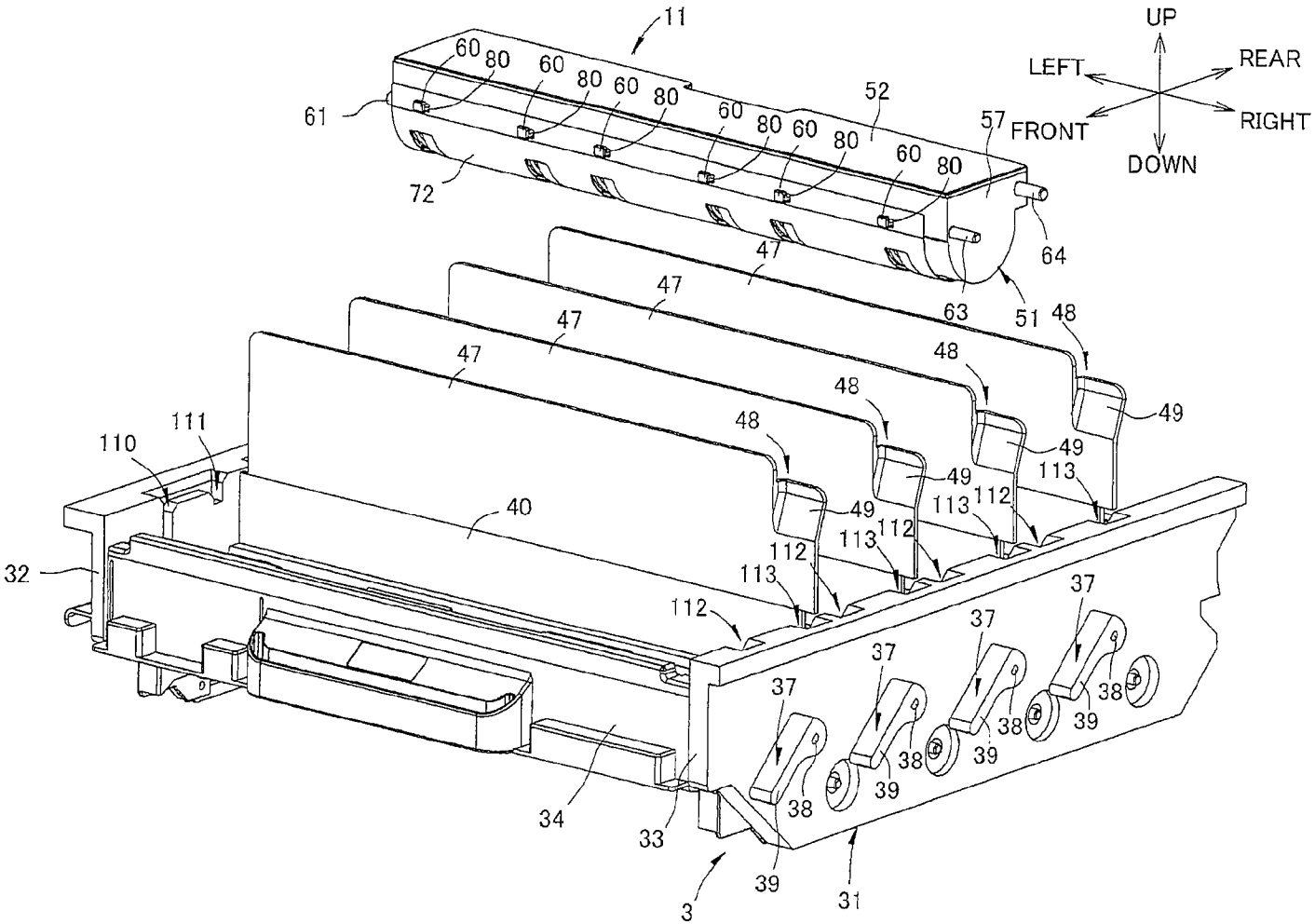
FIG. 4A is a perspective view of the drawer unit and a toner cartridge detached from the drawer unit.

As shown in FIG. 4A, the drawer frame (support member) 31 includes a pair of left and right side plates 32 and 33 disposed in confrontation with each other with a gap defined therebetween in the right-left direction, a front beam 34 spanning between front ends of the side plates 32 and 33, and a rear beam (not shown) spanning between rear ends of the side plates 32 and 33, and is formed in a rectangular frame shape on the whole in a plan view.

The four photosensitive drums 5, the four chargers 6, and the four developing units 7 (FIG. 1) are all supported by and sandwiched between the side plates 32 and 33 on the left and right sides. The spaces 12 are defined between the side plates 32 and 33 at positions above the developing units 7. In other words, the side plates 32 and 33 support the four photosensitive drums 5, the four chargers 6, and the four developing units 7, and are disposed opposite to each other in the right-left direction while defining a gap therebetween in the right-left direction for the spaces 12.

The right side plate 33 is provided with four operation members 37 corresponding to the four spaces 12. Each operation member 37 includes a shaft 38 and a lever 39. The shaft 38 extends and penetrates through the right side plate 33 in the right-left direction and is rotatable with respect to the right side plate 33. The lever 39 is fixed to the shaft 38. The operation member 37 is pivotable about the shaft 38 to move between a first position at which the lever 39 extends along the horizontal direction (front-rear direction) and a second position shown in FIG. 4A at which the lever 39 extends diagonally downward toward the front.

Figure 4B:
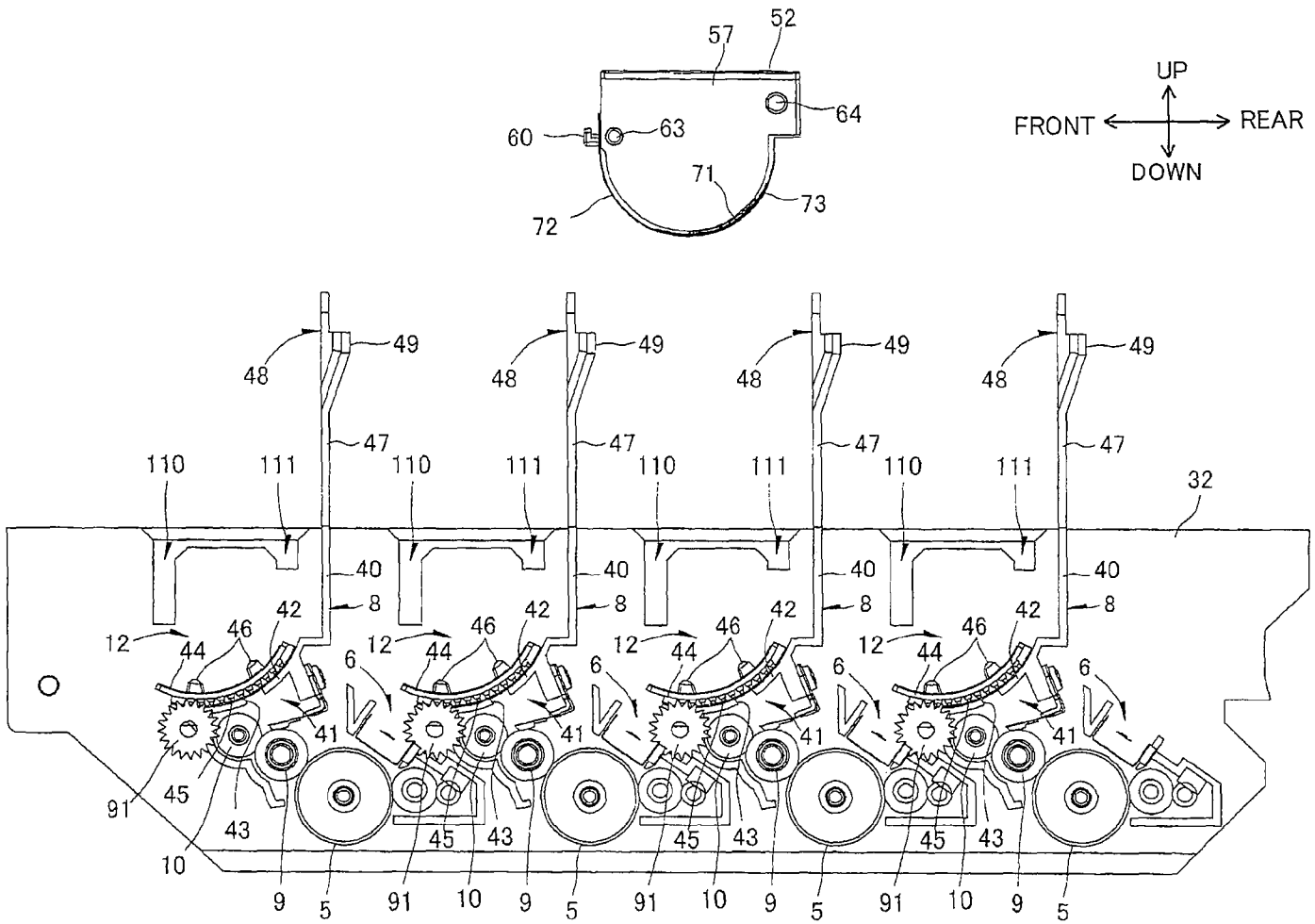
FIG. 4B is a cross-sectional right side view of the drawer unit and the toner cartridge detached from the drawer unit.

As shown in FIG. 4B, the four developing frames 8 are juxtaposed with one another at regular intervals in the front-rear direction and spanning between the side plates 32 and 33. The spaces 12 are partitioned by the developing frames 8.

Each developing frame 8 is formed with a developing chamber 41 for accommodating the developing roller 9. The developing chamber 41 is open on a photosensitive drum 5 side, and the developing roller 9 is disposed at this open end of the developing chamber 41.

Each developing frame 8 is provided with a plate-shaped partitioning wall 42 located between the developing chamber 41 and the space 12. The partitioning wall 42 protrudes in an arc shape toward the developing chamber 41, and partitions the interior of the developing frame 8 into the developing chamber 41 and the space 12 located higher than the developing chamber 41. The partitioning wall 42 is formed with three rectangular openings 43 (only one of which is shown) along a circumferential center thereof, at positions that oppose respective three communication ports 58 (FIG. 5) formed in the toner cartridge 11 when the toner cartridge 11 is accommodated in the space 12.

The developing frame 8 has a space partitioning wall 40 that extends upward from an upper end of the partitioning wall 42 and that partitions between the spaces 12.

Four shutter driving members 44 are movably disposed above the partitioning walls 42.

Each shutter driving member 44 is for driving a shutter 73 to be described later, and is formed in a plate shape protruding toward the developing chamber 41 in an arc shape that substantially follows the partitioning wall 42. A pair of rack gears 45 is formed one at either right or left end section on a bottom surface of the shutter driving member 44. An upper surface of the shutter driving member 44 is formed with shutter-driving protrusions 46 at positions opposite to shutter-driving holes 88 (FIG. 5) to be described later.

The drawer frame 31 is provided with four cover members 47 corresponding to the spaces 12. Each cover member 47 is formed substantially in a rectangular plate shape extending in the right-left direction. One end of the cover member 47 extending along the right-left direction is pivotably linked to an upper end of the space partitioning wall 40, and the cover member 47 can change its posture between an opening posture shown in FIGS. 4A and 4B and a closing posture shown in FIG. 3. The cover member 47 in the opening posture extends upward from the upper end of the space partitioning wall 40 as shown in FIGS. 4A and 4B, and can tilt frontward to the closing posture to extend along an upper surface of the drawer frame 31 as shown in FIG. 3.

Assuming that the cover member 47 is in the closing posture as shown in FIG. 3, the cover member 47 is formed with a rectangular cutout 48 (FIG. 4A) at a right-front corner thereof, and a knob 49 is formed at the cutout 48. The knob 49 extends diagonally upward and frontward and then bends to extend further frontward. This configuration of the knob 49 enables a user of the color printer 1 to inspect, from the outside, the interior of the drawer frame 31 through a space 50 beneath the knob 49 when the cover member 47 is in the closing posture. Thus, even if the cover member 47 is in the closing posture with the toner cartridge 11 accommodated in the space 12, the user can see and confirm the presence of the toner cartridge 11 in the space 12 through the space 50 beneath the knob 49. In this regard, the space 50 functions as a judging unit.

As shown in FIG. 4A, an inner surface (right surface) of the left side plate 32 is formed with a pair of open-top guide grooves 110 and 111 in correspondence with each space 12. The guide grooves 110 and 111 are formed with an interval therebetween in the front-rear direction, and each extends in the up-down direction. The groove 110 on the front side has a longer dimension in the up-down direction than the groove 111 on the rear side.

An inner surface (left surface) of the right side plate 33 is formed with a pair of open-top guide grooves 112 and 113 in correspondence with each space 12. The guide grooves 112 and 113 are formed with an interval therebetween in the front-rear direction, and each extends in the up-down direction. The groove 112 on the front side has a longer dimension in the up-down direction than the groove 113 on the rear side.

Figure 5:
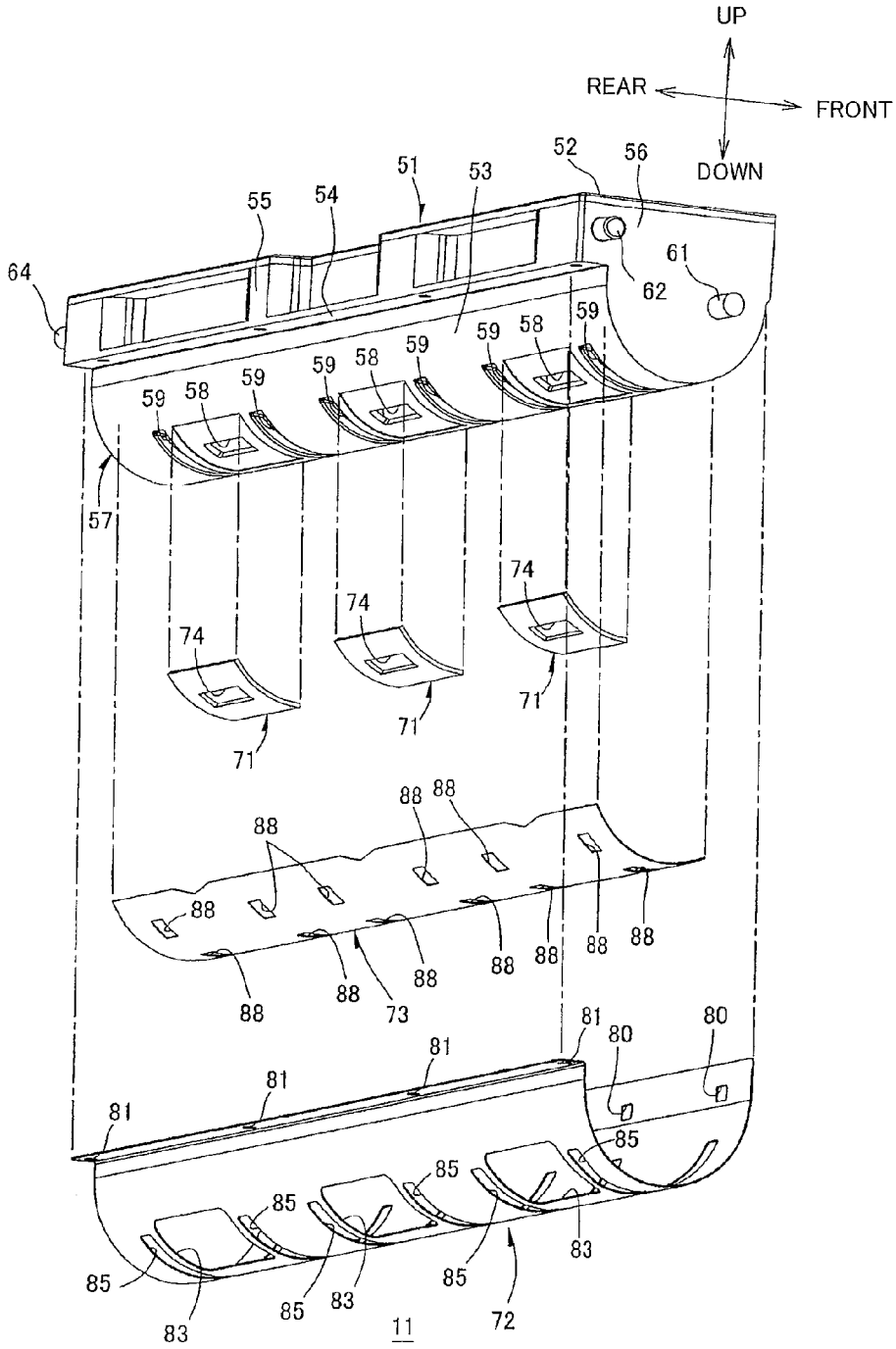
FIG. 5 is an exploded perspective view of the toner cartridge shown in FIG. 4A.

As shown in FIG. 5, the toner cartridge 11 includes a casing 51 formed of resin for accommodating toner therein. The casing 51 is formed substantially in a hollow semicircular column shape with a longer dimension in the right-left direction. More specifically, the casing 51 defines a space therein for accommodating toner, and has an upper surface 52 substantially in a rectangular shape elongated in the right-left direction, an arc surface (outer circumferential surface) 53 connected to a front edge of the upper surface 52 and protruding downward in an arc shape to form substantially a semicircular shape in cross-section, a fixing surface 54 extending rearward parallel to the upper surface 52 from a rear edge of the arc surface 53, a rear surface 55 spanning between a rear edge of the upper surface 52 and a rear edge of the fixing surface 54, a left surface 56 spanning between left edges of the surfaces 52, 53, 54, and 55, and a right surface 57 spanning between the right edges of the surfaces 52, 53, 54, and 55.

The arc surface 53 is formed with the three communication ports (openings) 58 mentioned above at positions slightly rearward of a lowest section of the arc surface 53 for fluidly connecting between inside and outside of the casing 51. The communication ports 58 are formed at fixed intervals in the right-left direction, and each is formed in a rectangular shape elongated in the right-left direction.

The arc surface 53 is also formed with an escape groove 59 on each of the right and left sides of each communication port 58. Each escape groove 59 is narrow in the right-left direction and extending along a circumferential direction of the arc surface 53.

As shown in FIG. 4A, a plurality of positioning protrusions 60 is formed at fixed intervals along the right-left direction at a front end section on the arc surface 53. Each of the positioning protrusions 60 extends frontward and bends upward into a hook (see FIG. 4B).

As shown in FIG. 5, a column-shaped guided protrusion 61 is formed on the left surface 56 at a position slightly frontward of a center of a region surrounded by a circumferential edge of the arc surface 53. A column-shaped guided protrusion 62 is formed at an upper rear section on the left surface 56.

As shown in FIG. 4A, the right surface 57 is formed with a column-shaped guided protrusion 63 at a center in the up-down direction of a front end section thereof and a column-shaped guided protrusion 64 at an upper rear section thereof.

As shown in FIG. 5, the toner cartridge 11 further includes toner seals 71 attached on the arc surface 53 of the casing 51, a shutter cover 72 for covering over the arc surface 53, and the shutter 73 disposed between the arc surface 53 and the shutter cover 72.

The toner seals 71 are provided in correspondence with the communication ports 58, and each is formed in a sheet shape with an opening 74 corresponding to the communication port 58 and attached on the arc surface 53 of the casing 51 such that the opening 74 confronts and fluidly communicates with the communication port 58 and that the toner seal 71 surrounds the communication port 58.

The shutter cover 72 is made of a resin film and curved to follow the arc surface 53 of the casing 51. The shutter cover 72 has substantially the same width in the right-left direction as the arc surface 53 and covers substantially the entire width of the arc surface 53 in the right-left direction.

The shutter cover 72 is formed at a front end section thereof with a plurality of positioning openings 80 at intervals in the right-left direction. As shown in FIG. 4A, the positioning protrusions 60 formed on the arc surface 53 of the casing 51 engage with the respective positioning openings 80. More specifically, the front end section of the shutter cover 72 is formed with the positioning openings 80 having the size capable of receiving the positioning protrusions 60 at the same positions as the positioning protrusions 60 in the right-left direction. The positioning protrusions 60 are inserted through the positioning openings 80, and upper edges of the positioning openings 80 are engaged with the positioning protrusions 60.

As shown in FIG. 5, a rear end section of the shutter cover 72 is bent to extend along the fixing surface 54 of the casing 51, and is formed with a plurality of screw insertion holes 81 at intervals in the right-left direction. The shutter cover 72 is attached to the casing 51 by engaging the positioning openings 80 with the positioning protrusions 60, inserting screws (not shown) through the screw insertion holes 81, and screwing the screws into the fixing surface 54 of the casing 51.

The shutter cover 72 is also formed with a plurality of toner openings 83 at positions opposing the toner seals 71. Each toner opening 83 is formed in a rectangular shape with a long dimension in the right-left direction. The toner opening 83 has a larger area than the communication port 58 so as to entirely expose the communication port 58.

The shutter cover 72 is further formed with a plurality of guide openings 85 at positions opposing the escape grooves 59 formed in the casing 51. Each guide opening 85 extends in the front-rear direction (in the circumferential direction of the shutter cover 72) to a length equal to or greater than a length of the escape groove 59 in the front-rear direction, and each guide opening 85 has a greater width than the escape groove 59 in the right-left direction. The guide opening 85 opposes the entire region of the corresponding escape groove 59.

The shutter 73 is made of a resin film and curved along the arc surface 53 of the casing 51. The shutter 73 is interposed between the arc surface 53 of the casing 51 and the shutter cover 72 and is moved between an opening position and a closing position while supported by the arc surface 53 and the shutter cover 72.

The shutter 73 has a slightly smaller length than the shutter cover 72 with respect to the right-left direction, and a greater width than the toner seal 71 with respect to the circumferential direction of the arc surface 53, which width is set such that the shutter 73 does not contact the fixing surface 54 of the casing 51 nor the positioning protrusions 60 (FIG. 4A) when the shutter 73 is moved between the opening position and the closing position.

When the toner cartridge 11 is accommodated into the space 12, the shutter-driving protrusions 46 shown in FIG. 4B penetrate through the guide openings 85 and engage with the shutter driving openings 88, thereby linking the shutter driving member 44 to the shutter 73.

The shutter 73 is formed with pairs of shutter driving openings 88 at positions opposing the escape grooves 59. The two shutter driving openings 88 of each pair are spaced apart from each other in the circumferential direction of the shutter 73. The gap between the two shutter driving openings 88 of each pair is determined such that all of the shutter driving openings 88 oppose and fluidly communicate with both the escape grooves 59 and the guide openings 85 regardless of whether the shutter 73 is located at the opening position or the closing position.

When the shutter 73 is located at the opening position, a rear end section of the shutter 73 is located between front sections of the toner seals 71 and the shutter cover 72 (i.e., the rear end section of the shutter 73 is located frontward of the openings 74). Thus, the communication ports 58 in fluid communication with the openings 74 are exposed to fluidly communicate between inside and outside of the casing 51.

When the shutter 73 is located at the closing position rearward of the opening position, on the other hand, the rear end section of the shutter 73 is positioned slightly rearward of rear edges of the toner openings 83. Thus, the shutter 73 entirely covers over both the communication ports 58 of the casing 51 and the openings 74 of the toner seals 71 and blocks off the fluid communication between inside and outside of the casing 51. In this state, the toner seals 71 are interposed between the shutter 73 and the arc surface 53 of the casing 51.

Figure 6:
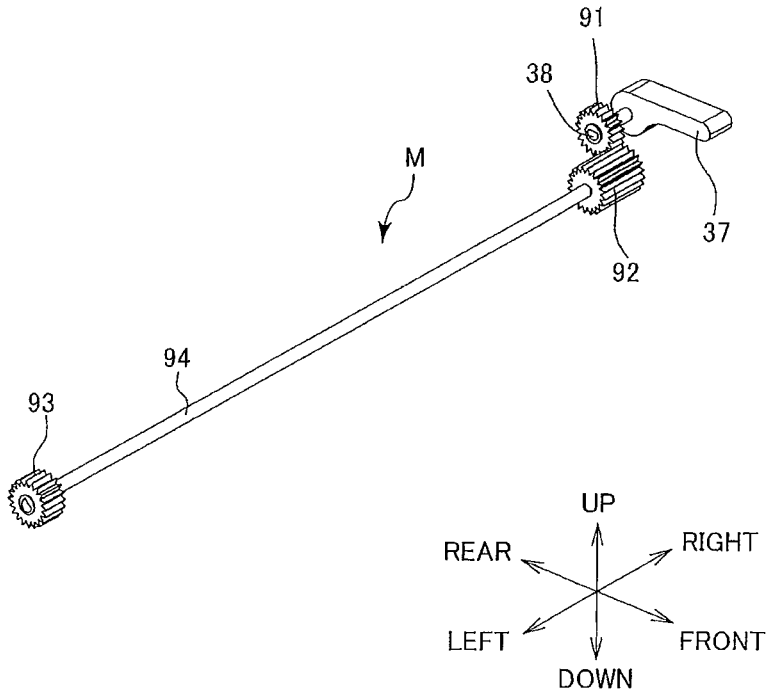
FIG. 6 is a perspective view of a driving force transmission mechanism of the color printer of FIG. 1.

A driving force transmission mechanism M shown in FIG. 6 is provided for each shutter driving member 44. The driving force transmission mechanism M is for transmitting driving force to the corresponding shutter driving member 44 and is disposed within the drawer frame 31.

Specifically, the driving force transmission mechanism M includes a drive gear 91, a right pinion gear 92, a left pinion gear 93, and a connecting shaft 94. The drive gear 91 is not rotatably fixed to a left end of the shaft 38 of the operation member 37. The right pinion gear 92 has a width in the right-left direction, and a right section of the right pinion gear 92 is meshingly engaged with the drive gear 91, and a left section of the right pinion gear 92 is meshingly engaged with one of the rack gears 45 (FIG. 4B) of the shutter driving member 44 on the right side. The left pinion gear 93 is meshingly engaged with the other of the rack gears 45 on the left side. The right pinion gear 92 and the left pinion gear 93 are connected to each other by the connecting shaft 94.

When the operation member 37 is operated to rotate the drive gear 91, the drive gear 91 supplies rotative force to the right pinion gear 92. The rotative force supplied to the right pinion gear 92 is input to the rack gear 45 on the right side and is also input to the rack gear 45 on the left side through the connecting shaft 94 and the left pinion gear 93. As a result, the shutter driving member 44 moves in the front-rear direction along the partitioning wall 42, and the shutter 73 linked to the shutter driving member 44 is moved together with the shutter driving member 44 between the opening position and the closing position.

Attachment and detachment of the toner cartridge 11 will be described next. As shown in FIGS. 4A and 4B, the toner cartridge 11 is attached into and detached from the space 12 of the drawer frame 31 while the drawer unit 3 (the drawer frame 31) is located at the pulled-out position outside the main casing 2 (FIG. 3). Note that attachment of the toner cartridge 11 into the space 12 also means attachment of the toner cartridge 11 onto the developing unit 7.

When the toner cartridge 11 is detached from the drawer unit 3, the shutter 73 is located at the closing position.

In order to accommodate the toner cartridge 11 into one of the spaces 12, the cover member 47 corresponding to this space 12 is moved to the opening posture as shown in FIGS. 4A and 4B. At this time, the corresponding operation member 37 is located at the second position as shown in FIG. 4A. Then, the guided protrusions 61 and 62 (FIG. 5) formed on the left surface 56 of the casing 51 are respectively inserted into the guide grooves 110 and 111 (FIG. 4A) formed in the left side plate 32 from above. At the same time, the guided protrusions 63 and 64 formed on the right surface 57 of the casing 51 are respectively inserted into the guide grooves 112 and 113 formed in the right side plate 33 from above. Hence, the toner cartridge 11 is accommodated into the space 12 as shown in FIGS. 7A and 7B, as the guided protrusions 61 to 64 are guided along the guide grooves 110 to 113.

When the toner cartridge 11 is accommodated into the space 12, the shutter-driving protrusions 46 shown in FIG. 4B penetrate through the guide openings 85 and engage with the shutter driving openings 88, thereby linking the shutter driving member 44 to the shutter 73 as described above.

Figure 7A:
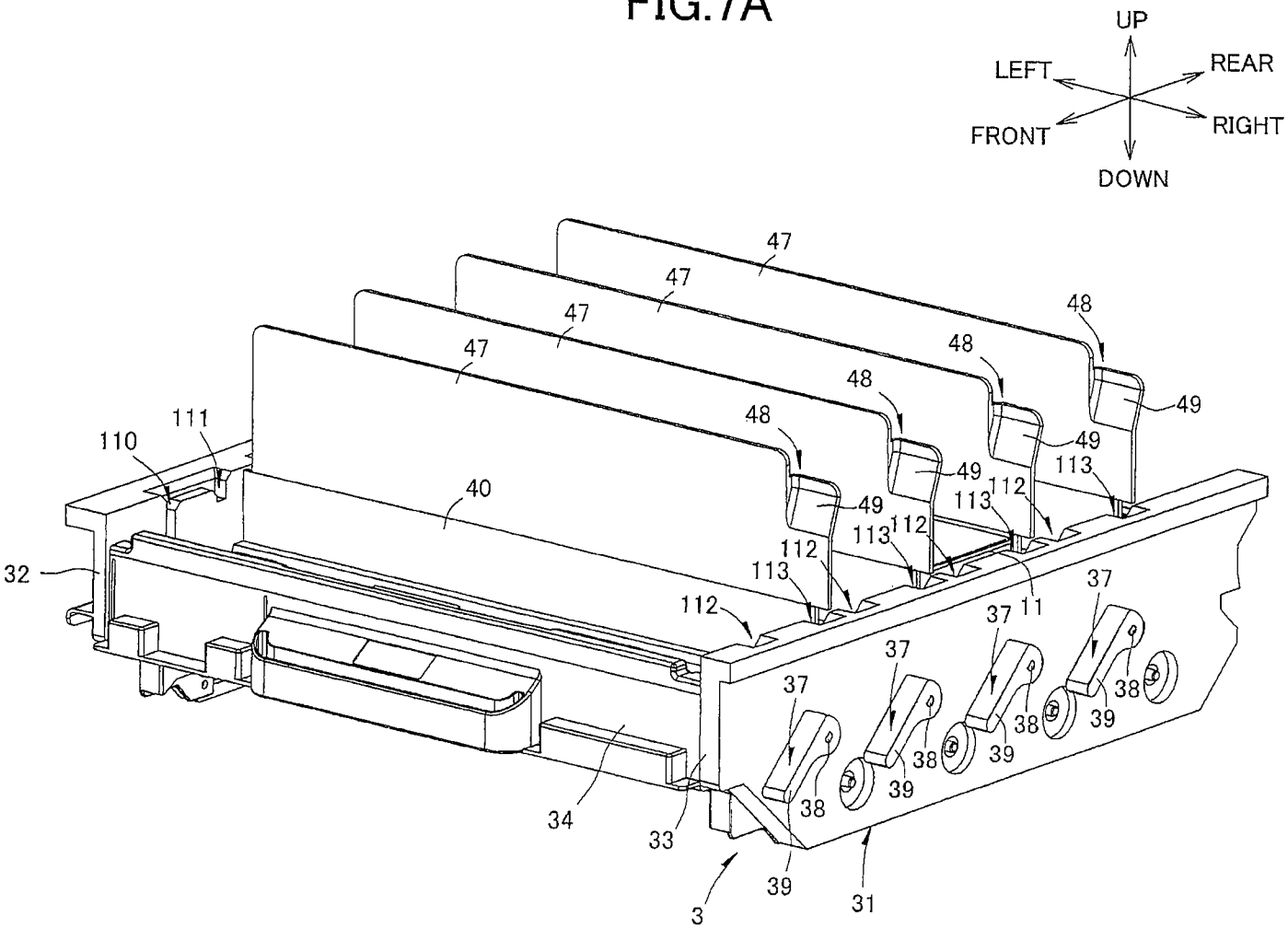
FIG. 7A is a perspective view of the drawer unit with one toner cartridge accommodated therein and cover members in opening postures.
Figure 7B:
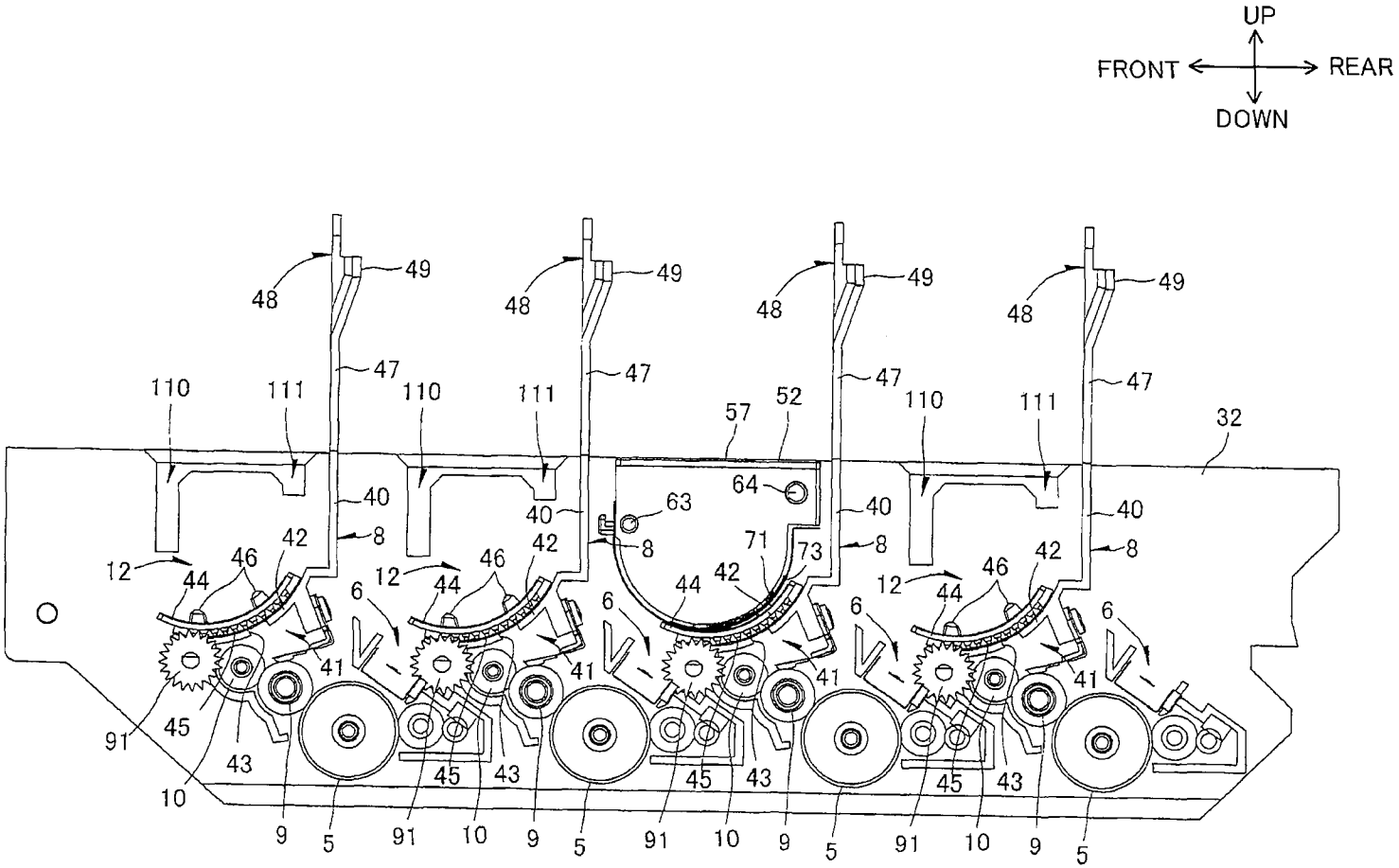
FIG. 7B is a cross-sectional right side view of the drawer unit with one toner cartridge accommodated therein and the cover members in the opening postures.
Figure 8:
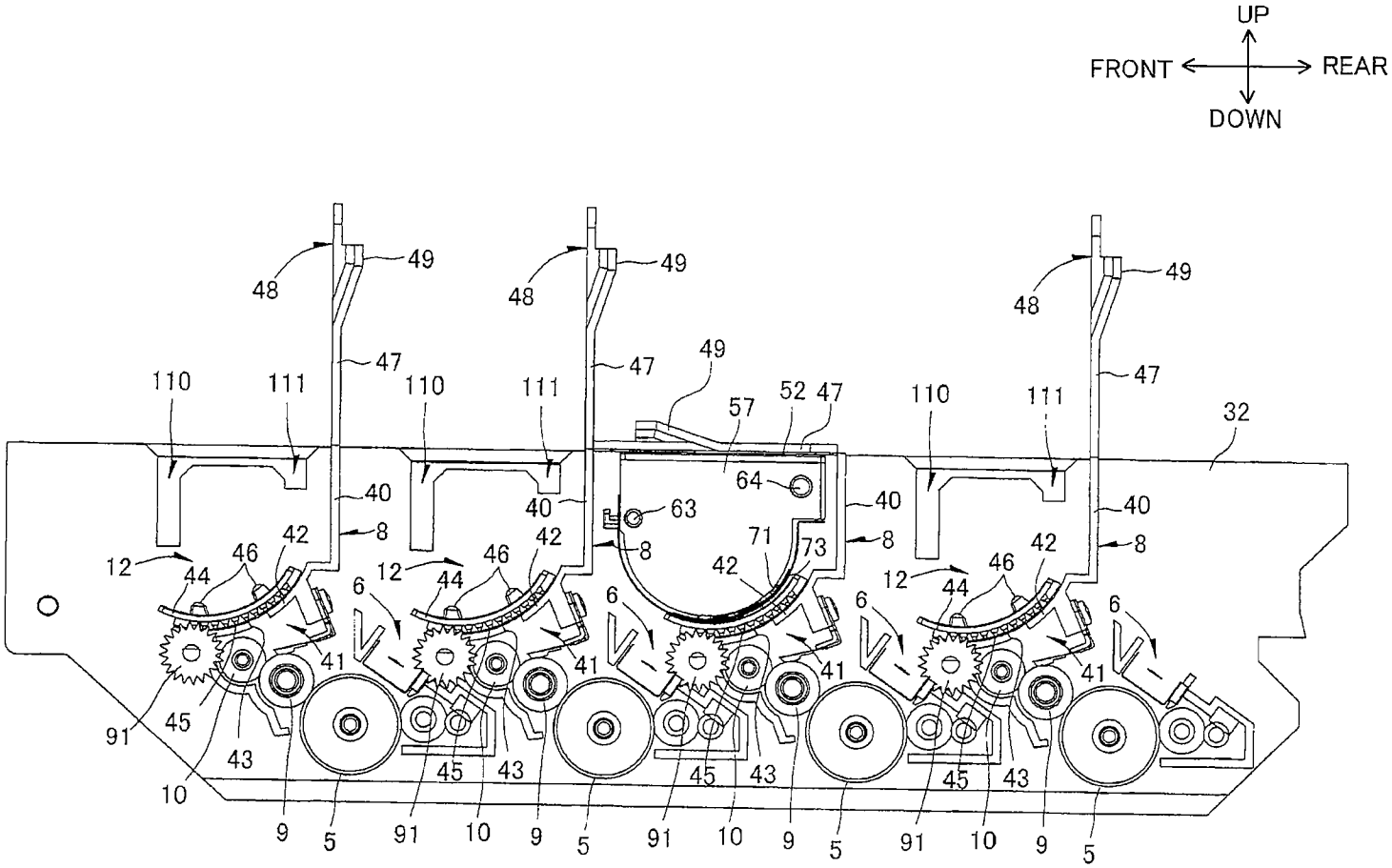
FIG. 8 is a cross-sectional right side view of the drawer unit with one toner cartridge accommodated therein and one cover member in an closing posture.

Then, the cover member 47 is moved from the opening posture to the closing posture as shown in FIG. 8, and the operation member 37 (FIG. 6) is moved from the second position shown in FIG. 7A to the first position shown in FIG. 6. Moving the operation member 37 to the first position in this manner rotates the drive gear 91 in a clockwise direction in a right side view, which in turn rotates the right pinion gear 92 and the left pinion gear 93 in a counterclockwise direction in a right side view. This rotation of the right pinion gear 92 and the left pinion gear 93 is transmitted to the rack gears 45 of the shutter driving member 44. As a result, the shutter driving member 44 located in opposition to the openings 43 of the partitioning wall 42 as shown in FIG. 4B is moved frontward to a position where the shutter driving member 44 does not oppose the openings 43. At this time, the shutter 73 moves frontward integrally with the shutter driving member 44 from the closing position to the opening position.

When the cover member 47 is in the closing posture, the cover member 47 opposes the toner cartridge 11 from above and covers over the upper side of the toner cartridge 11. In this condition, the toner cartridge 11 cannot be removed from the drawer frame 31. That is, the cover member 47 functions as a preventing member for preventing detachment of the toner cartridge 11 from the drawer frame 31.

When the front cover 4 (FIG. 1) is closed thereafter, then the color printer 1 is ready to start image forming operation.

When detaching the toner cartridge 11 from the drawer unit 3, first the front cover 4 is opened, and then the drawer unit 3 is pulled from the accommodated position to the pulled-out position.

Next, the operation member 37 is moved from the first position to the second position. This movement of the operation member 37 rotates the drive gear 91 (FIG. 6) in a counterclockwise direction in a right side view, which in turn rotates the right pinion gear 92 and the left pinion gear 93 in a clockwise direction in a right side view. The rotation of the right pinion gear 92 and the left pinion gear 93 is transmitted to the rack gears 45 of the shutter driving member 44 shown in FIG. 7B. As a result, the shutter driving member 44 is moved rearward from the position at which the shutter driving member 44 does not oppose the openings 43 to the position shown in FIG. 7B at which the shutter driving member 44 opposes the openings 43. At this time, the shutter 73 is moved rearward integrally with the shutter driving member 44 from the opening position to the closing position.

Then, the cover member 47 is moved from the closing posture shown in FIG. 8 to the opening posture shown in FIGS. 7A and 7B.

Thereafter, the toner cartridge 11 is lifted up from the space 12 as shown in FIGS. 4A and 4B. Because the shutter 73 of the toner cartridge 11 detached from the drawer unit 3 is located at the closing position, toner does not leak from the casing 51 of the detached toner cartridge 11.

As described above, the drawer frame 31 is movable between the accommodated position inside the main casing 2 and the pulled-out position outside the main casing 2. The drawer frame 31 is formed with the four spaces 12 for detachably accommodating the toner cartridges 11. The toner cartridges 11 can be detached from or mounted into the spaces 12 when the drawer frame 31 is at the pulled-out position. The drawer frame 31 supports the developing units 7 corresponding to the spaces 12.

Each toner cartridge 11 includes the casing 51 for accommodating toner therein, and the casing 51 is formed with the communication ports 58 for supplying toner to the corresponding developing unit 7. The communication ports 58 face downward when the toner cartridge 11 is in the space 12. The toner cartridge 11 also includes the shutter 73 that is movable between the opening position for exposing (opening) the communication ports 58 and the closing position for closing the communication ports 58.

The drawer frame 31 is provided with the cover members 47, each of which being movable between the opening posture and the closing posture. The cover member 47 in the opening posture exposes the upper side of the space 12. On the other hand, the cover member 47 in the closing posture confronts the space 12 from above and covers over the space 12. Thus, the cover member 47 in the closing posture prevents a user from seeing the space 12 which may be smeared with ink, and makes the drawer frame 31 look better. The cover member 47 also can prevent foreign matter other than toner from entering the space 12. Thus, it is possible to prevent foreign matter from entering the developing unit 7 (the developing chamber 41) through a toner supply path between the toner cartridge 11 and the developing unit 7.

As shown in FIG. 3, the space 50 is defined below the knob 49 for serving as the judging unit for enabling a user to judge whether or not the toner cartridge 11 is accommodated in the space 12. Thus, a user can easily confirm whether the toner cartridge 11 is accommodated in the space 12.

The opening posture of the cover member 47 is an upright posture in which the cover member 47 extends upward to a position above the space 12, and the closing posture of the cover member 47 is a lying posture. Thus, the cover member 47 can be easily switched between the opening posture and the closing posture by selectively turning up and down the same.

The drawer frame 31 is provided with the operation members 37 for moving the shutters 73 between the opening positions and the closing positions. Thus, it is possible to reliably and easily move each shutter 73 between the opening position and the closing position by operating the corresponding operation member 37.

Next, a second embodiment of the invention will be described with reference to FIGS. 9A to 11B. In the following description, only parts differing from those of the first embodiment will be described.

Figure 9A:
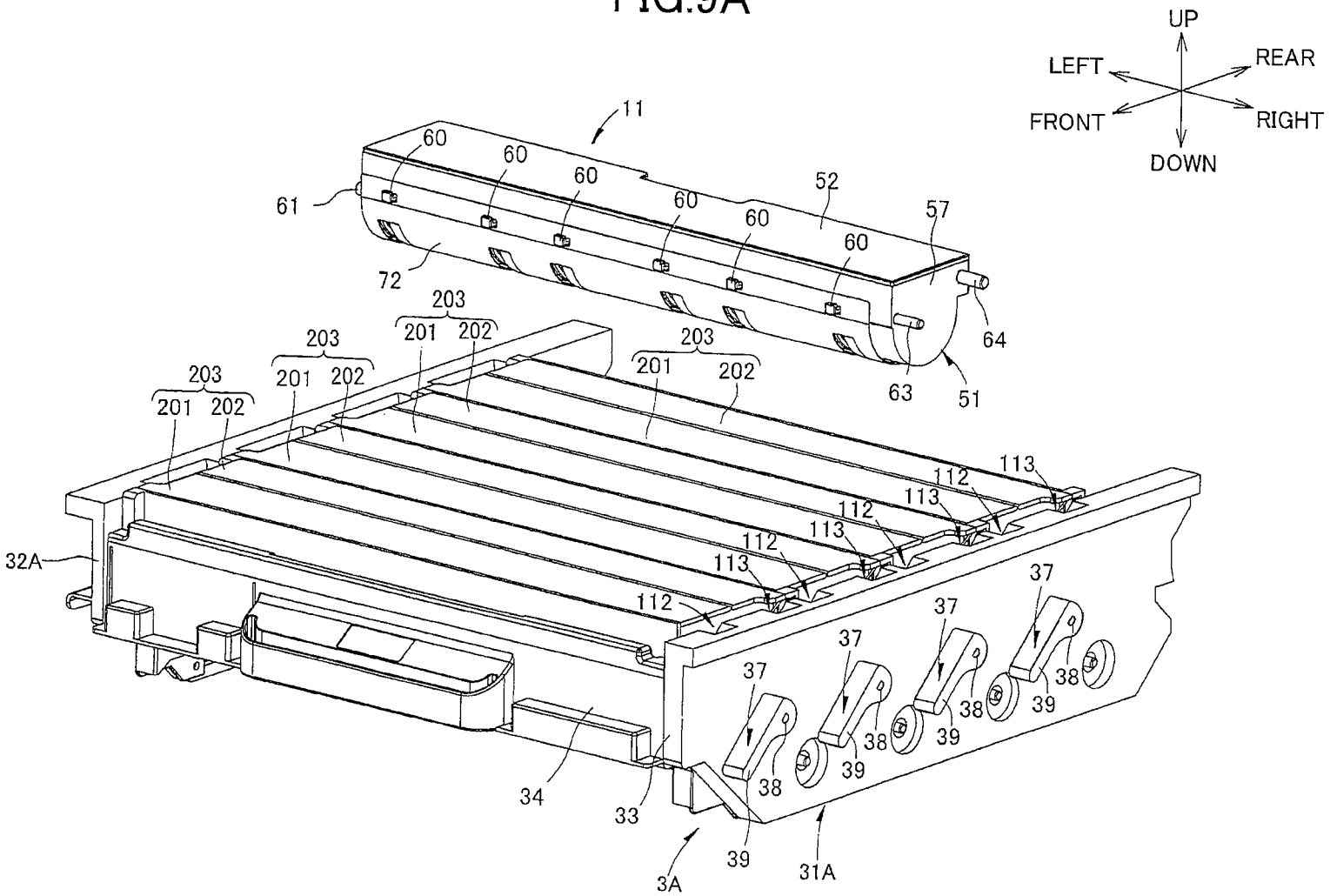
FIG. 9A is a perspective view of a drawer unit of a color printer according to a second embodiment of the invention, with a toner cartridge detached from the drawer unit.

As shown in FIG. 9A, a drawer frame 31A of the drawer unit 3A of this embodiment is provided with four cover members 203 instead of the cover members 47. The cover members 203 correspond to the spaces 12 of the drawer frame 31A, and each includes a first cover member 201 and a second cover member 202.

The cover members 203 (the first cover members 201 and the second cover members 202) are juxtaposed in the front-rear direction such that substantially no space exists between adjacent cover members 203 in the closing posture. The first and second cover members 201 and 202 are each formed substantially in a rectangular flat plate shape elongated in the right-left direction.

The first cover member 201 has a greater length than the second cover member 202 with respect to the front-rear direction. The first cover member 201 is pivotably supported to the drawer frame 31A so as to be pivotable about a pivot axis extending in the right-left direction. The first cover member 201 of the cover member 203 in the closing posture extends rearward from the pivot axis and has an upper surface substantially flush with both an upper surface of a left side plate 32A and the upper surface of the right side plate 33. On the other hand, the first cover member 201 of the cover member 203 in the opening posture is received in the space 12 and extends downward from the pivot axis as shown in FIG. 11B.

Figure 9B:
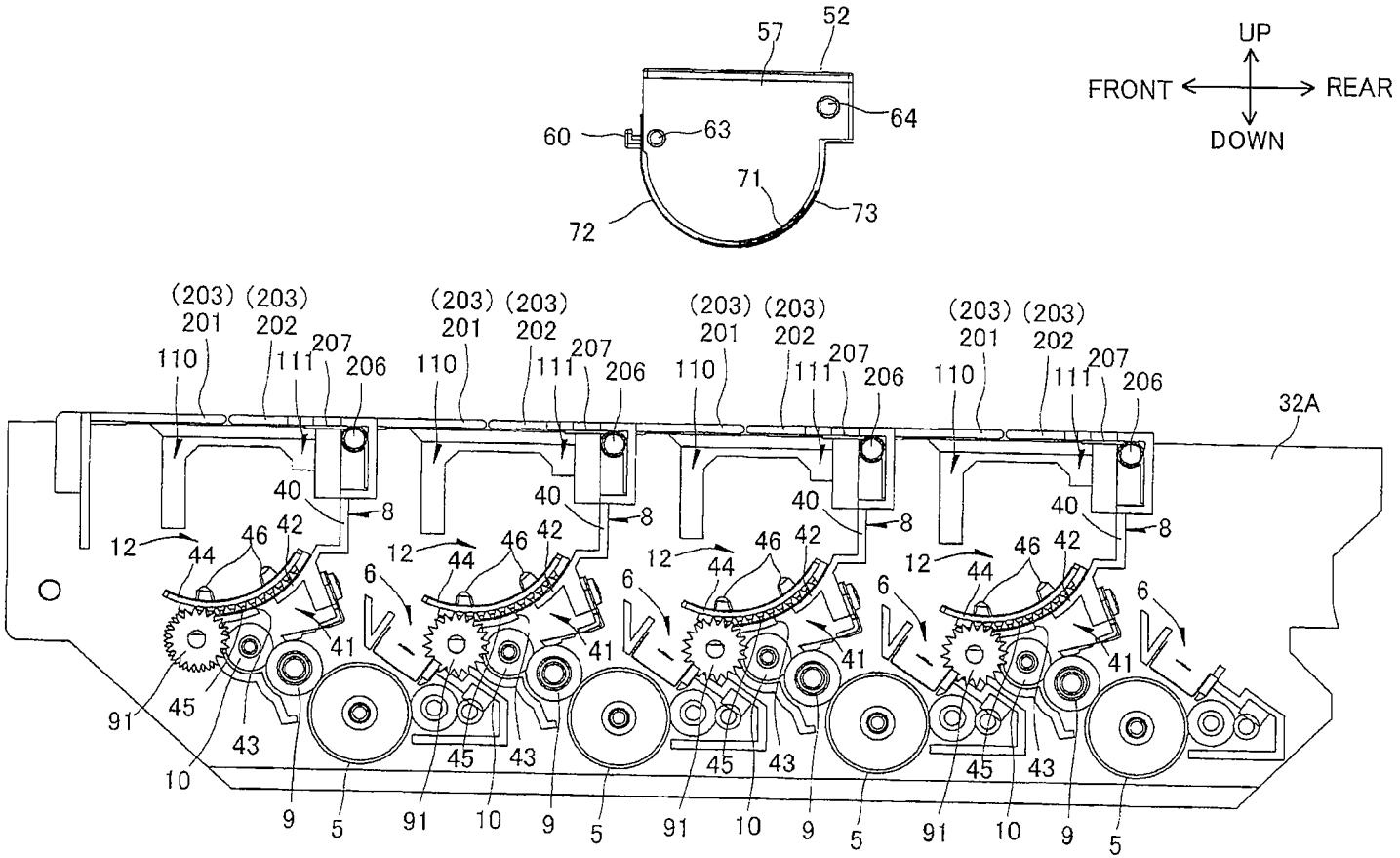
FIG. 9B is a cross-sectional right side view of the drawer unit according to the second embodiment of the invention, with the toner cartridge detached from the drawer unit.
Figure 9C:
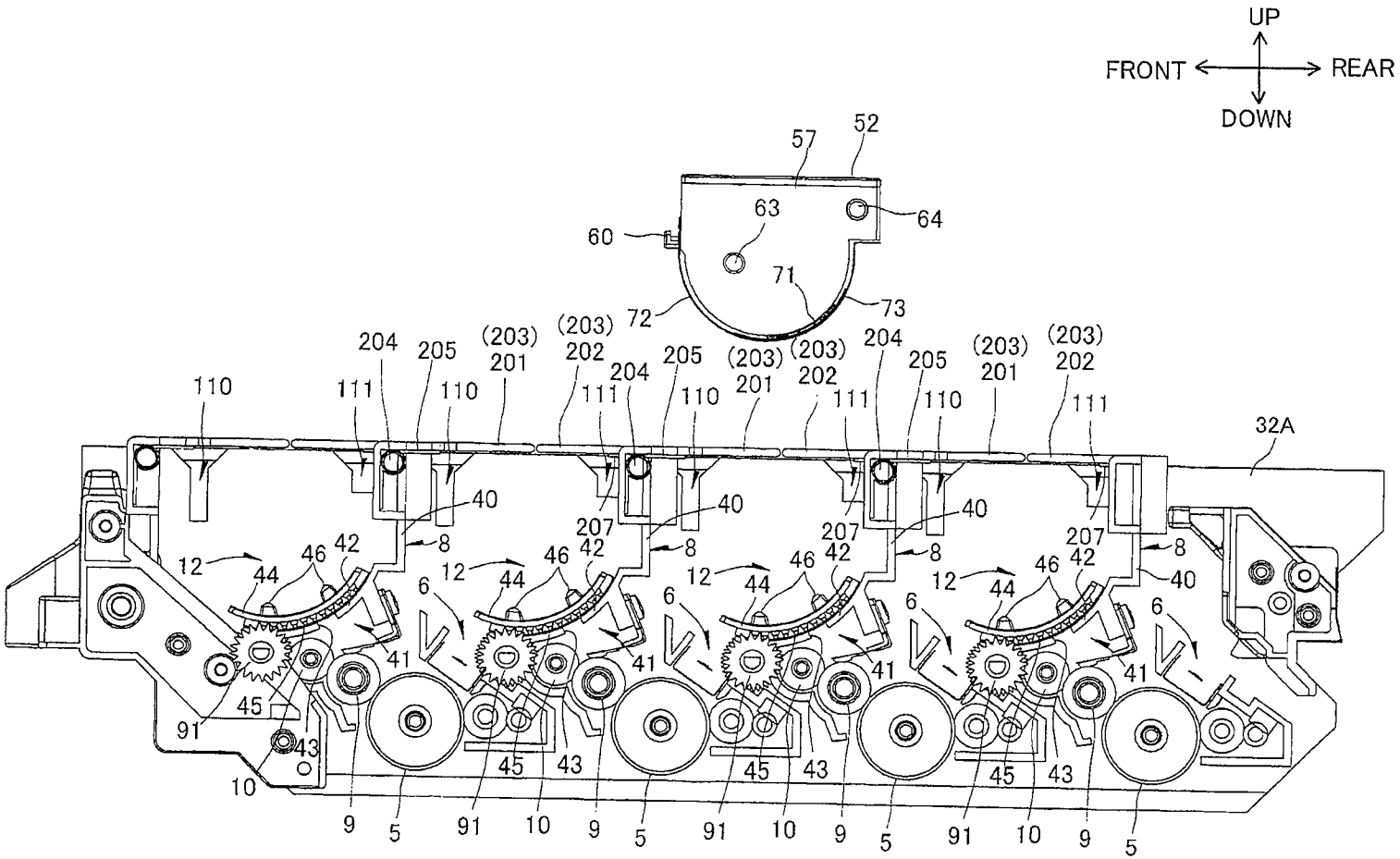
FIG. 9C is a cross-sectional right side view of the drawer unit according to the second embodiment of the invention, with the toner cartridge detached from the drawer unit.

As shown in FIG. 9C, the left side plate 32A of the drawer frame 31A is formed with a boss 204 at a position near the pivot axis of each first cover member 201. The boss 204 extends inward (rightward) from the inner surface of the left side plate 32A, and a leaf spring (urging member) 205 is wound on the boss 204. One end of the leaf spring 205 extends downward from the boss 204 and fixed to the drawer frame 31A. The other end of the leaf spring 205 extends rearward from the boss 204 and fixed to an inner surface of the first cover member 201. The resilient force of the leaf spring 205 urges the first cover member 201 in a counterclockwise direction in a right side view.

The second cover member 202 is pivotably supported to the drawer frame 31A so as to be pivotable about a pivot axis extending in the right-left direction. The second cover member 202 of the cover member 203 in the closing posture extends frontward from the pivot axis and has an upper surface substantially flush with the upper surfaces of the left and right side plates 32A and 33. The second cover member 202 of the cover member 203 in the opening posture is received in the space 12 and extends downward from the pivot axis as shown in FIG. 11B.

As shown in FIG. 9B, the left side plate 32A of the drawer frame 31 is also formed with a boss 206 at a position near the pivot axis of each second cover member 202. The boss 206 extends inward (rightward) from the inner surface of the left side plate 32A, and a leaf spring (urging member) 207 is wound on the boss 206. One end of the leaf spring 207 extends downward from the boss 206 and fixed to the drawer frame 31A. The other end of the leaf spring 207 extends frontward from the boss 206 and fixed to an inner surface of the second cover member 202. The resilient force of the leaf spring 207 urges the second cover member 202 in a clockwise direction in a right side view.

Note that the cross-sectional view of FIG. 9B is taken along a line different from a line along which the cross-sectional view of FIG. 9C is taken.

With this configuration, before the toner cartridge 11 is accommodated into the space 12, the cover members 203 are all in the closing postures as shown in FIGS. 9A to 9C. Note that the toner cartridge 11 is accommodated into and removed from the space 12 from above.

Figure 10A:
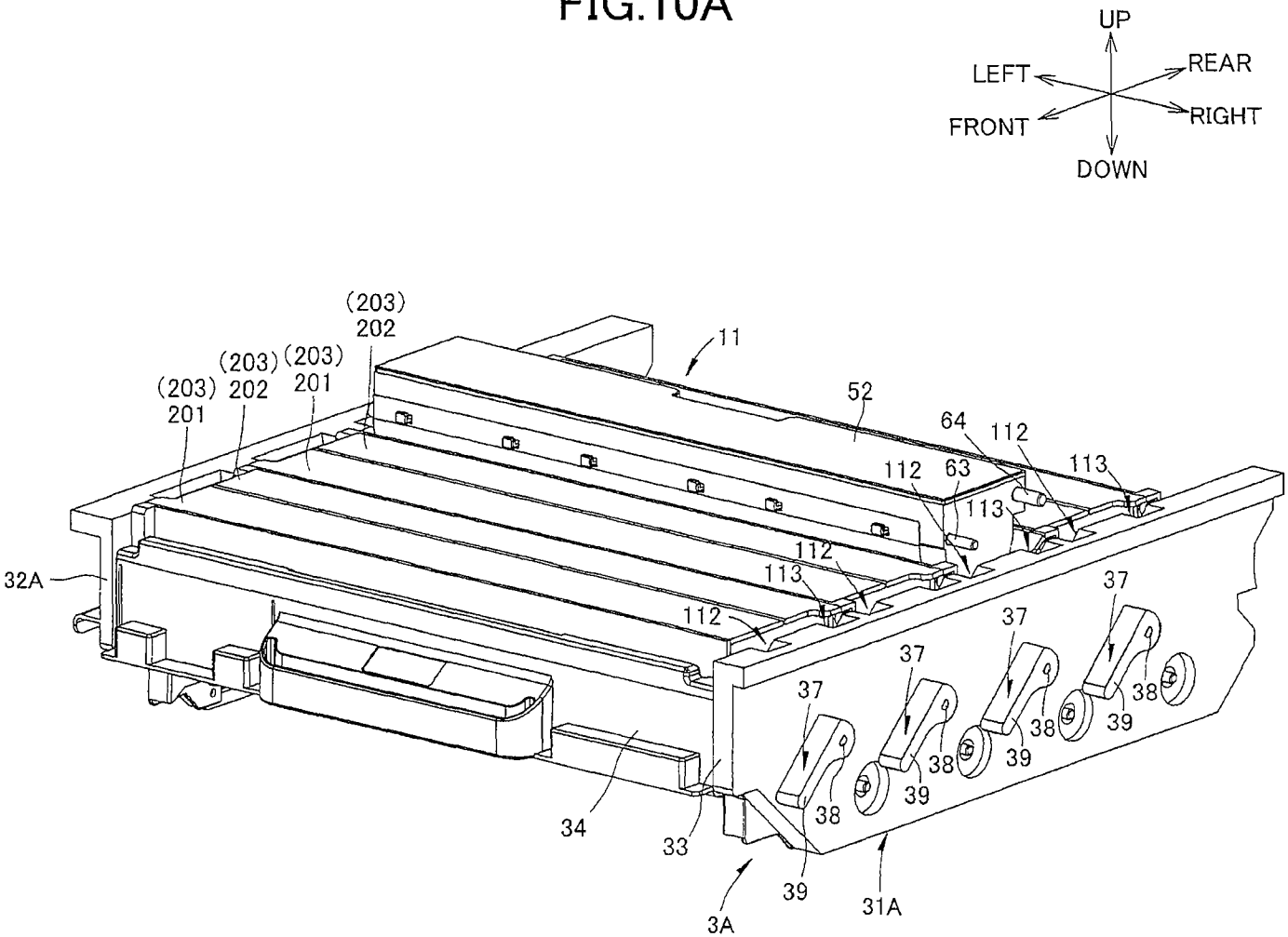
FIG. 10A is a perspective view of the drawer unit of the second embodiment with the toner cartridge being inserted halfway into the drawer unit and with a cover member shifted toward an opening posture.
Figure 10B:
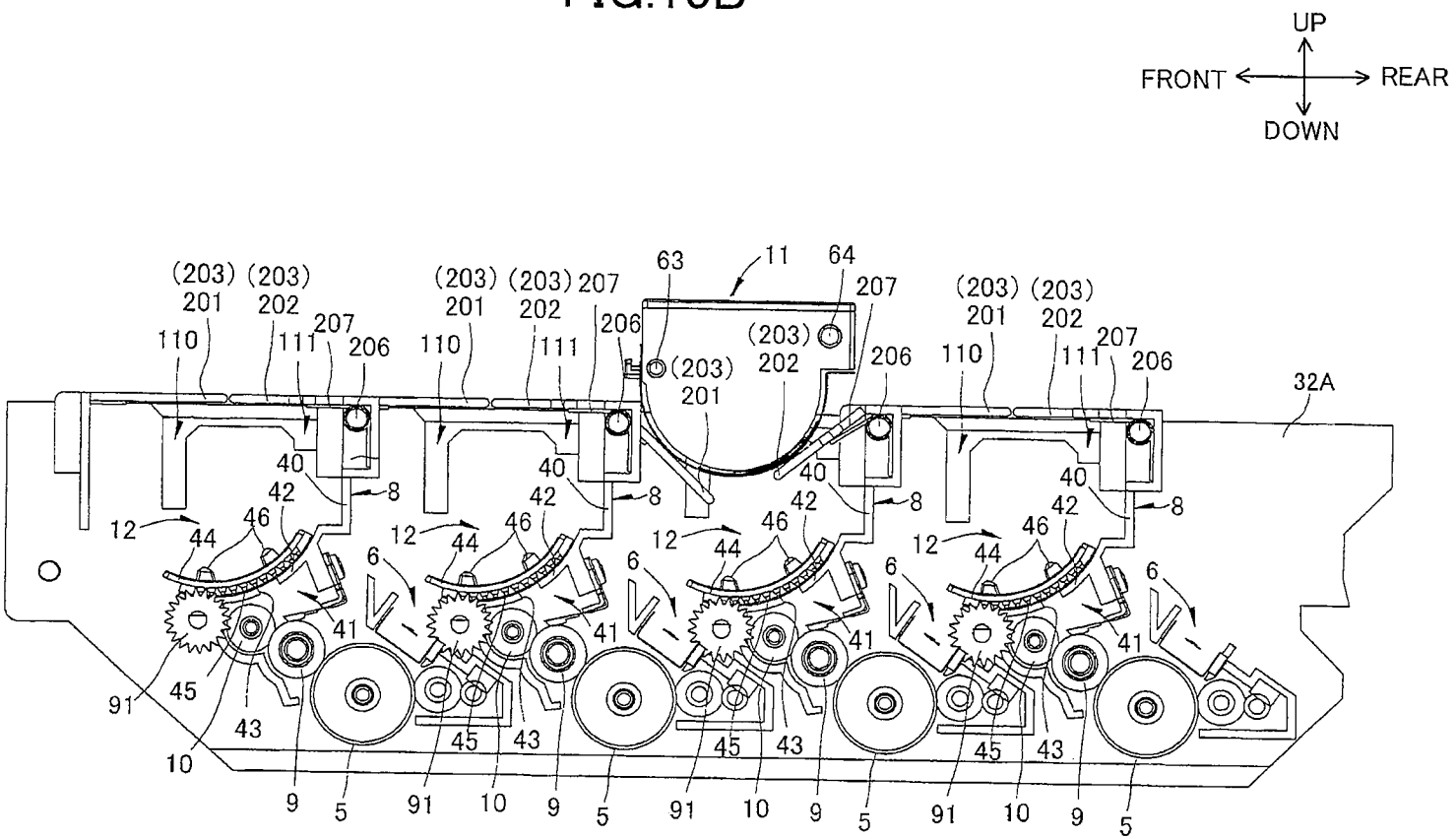
FIG. 10B is a cross-sectional right side view of the drawer unit of the second embodiment with the toner cartridge being inserted halfway into the drawer unit and with a cover member shifted toward an opening posture.

When the toner cartridge 11 is lowered toward the space 12, the toner cartridge 11 abuts the first cover member 201 and the second cover member 202. When the toner cartridge 11 is further lowered, then the toner cartridge 11 presses down the rear end of the first cover member 201 and the front end of the second cover member 202 as shown in FIGS. 10A and 10B. As a result, the first cover member 201 and the second cover member 202 pivot toward inside the space 12.

Figure 11A:
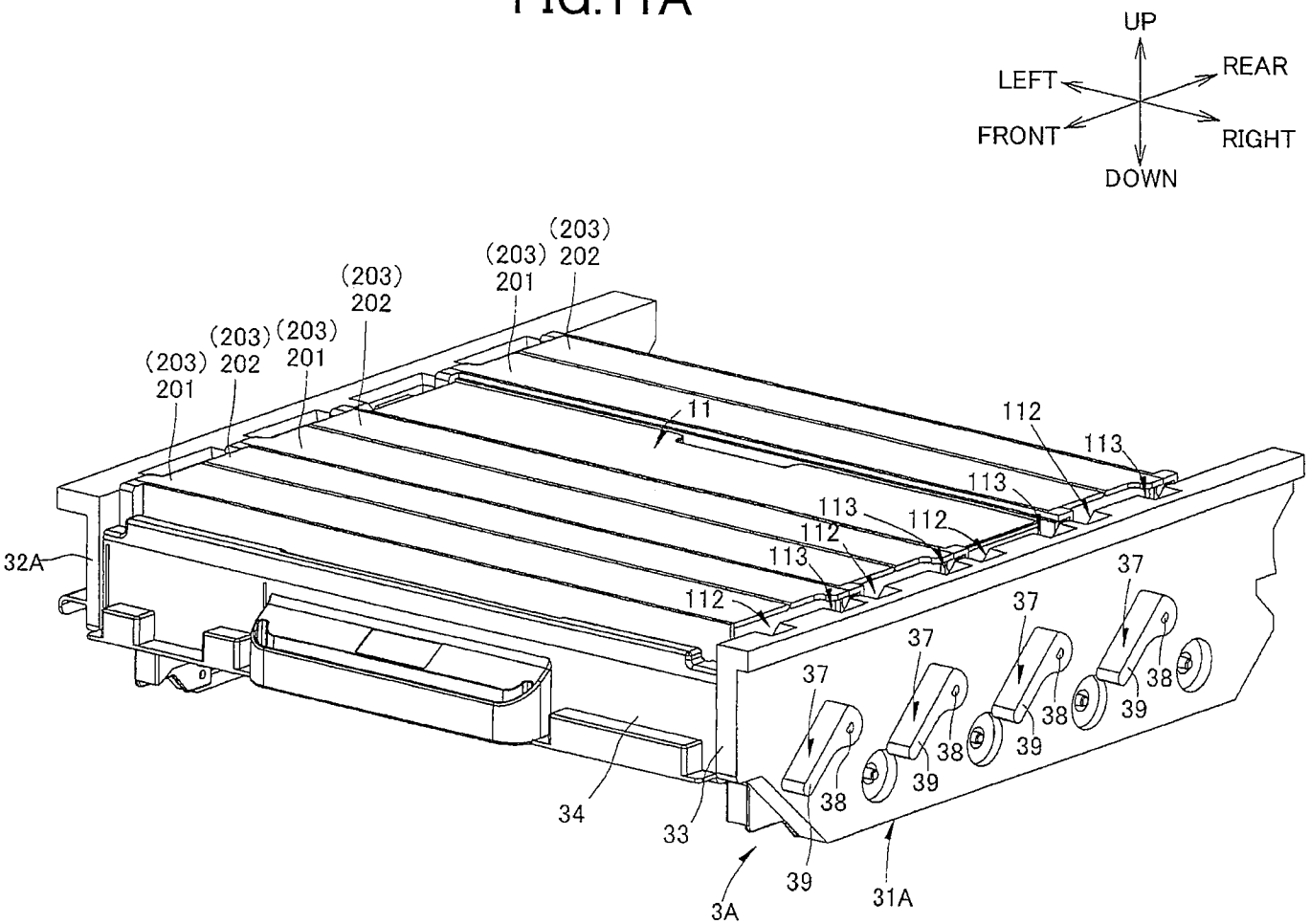
FIG. 11A is a perspective view of the drawer unit of the second embodiment with one toner cartridge accommodated in the drawer unit and one cover member in an opening posture.
Figure 11B:
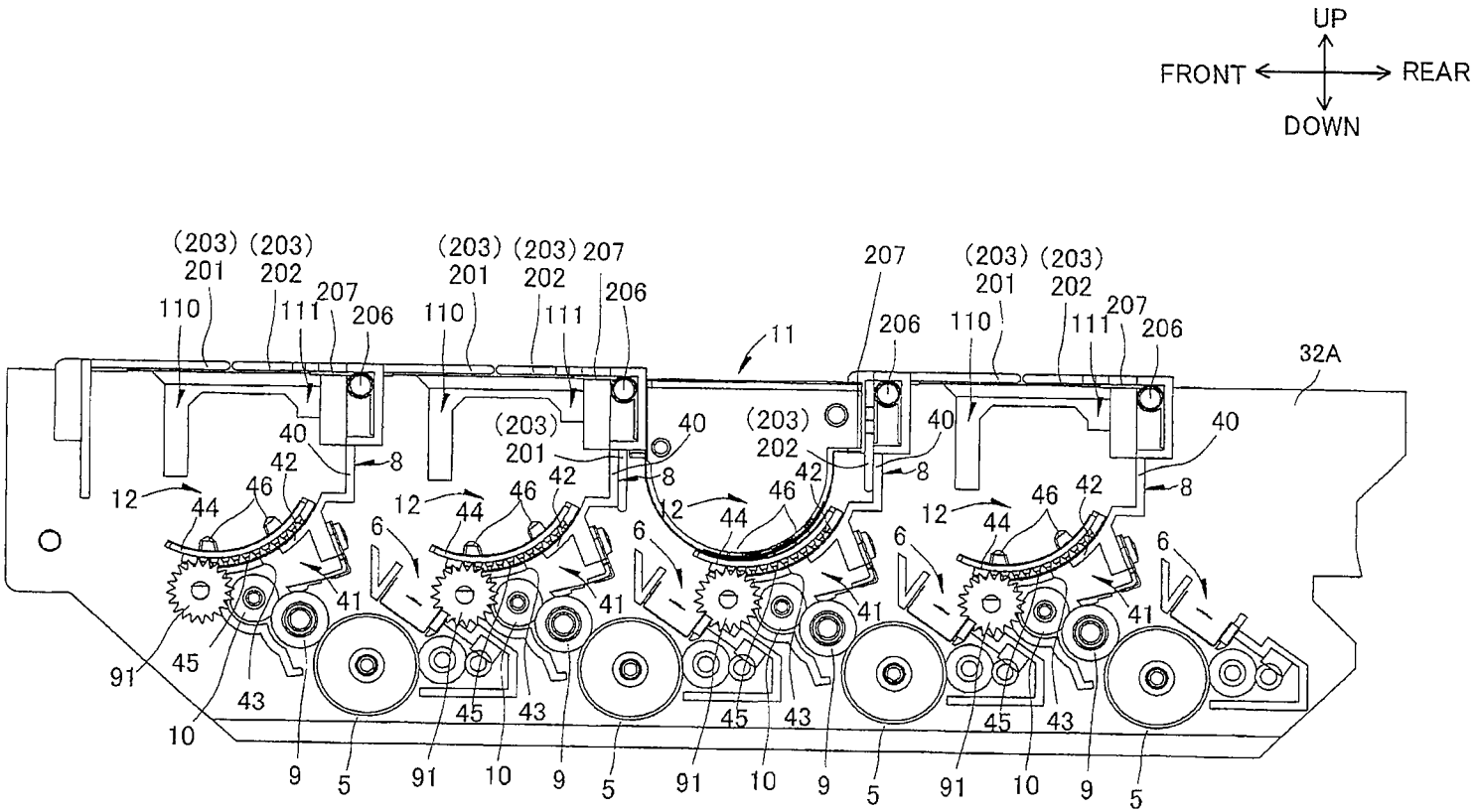
FIG. 11B is a cross-sectional right side view of the drawer unit of the second embodiment with one toner cartridge accommodated in the drawer unit and one cover member in the opening posture.

As shown in FIGS. 11A and 11B, when the toner cartridge 11 is completely inserted into the space 12, the first cover member 201 and the second cover member 202 extend downward and confront the toner cartridge 11 from the front and rear sides, respectively. That is, the cover member 203 reaches the opening posture.

As the toner cartridge 11 is removed upward from the space 12, on the other hand, the urging force of the leaf springs 205 and 207 pivots the first cover member 201 and the second cover member 202 to move the rear end of the first cover member 201 and the front end of the second cover member 202 upward. When the toner cartridge 11 separates from the first cover member 201 and the second cover member 202, the cover member 203 reaches the closing posture.

This configuration of the second embodiment can achieve the following effects, in addition to the same effects as the configuration of the above-described first embodiment.

The cover member 203 switches from the closing posture to the opening posture as the toner cartridge 11 is accommodated into the space 12, and the cover member 203 in the opening posture opposes the toner cartridge 11 in the space 12 from both the front and rear sides thereof. Thus, the cover member 203 in the opening posture does not interfere with attachment and detachment of the toner cartridge 11 to and from the space 12.

Because the cover member 203 is divided into the first cover member 201 on the front side and the second cover member 202 on the rear side, the first cover member 201 and the second cover member 202 have relatively shorter length in the up-down direction in their opening postures. Thus, even if the cover member 203 is configured to be accommodated within the space 12 in the closing posture, it is unnecessary to enlarge the dimension of the space 12 in the up-down direction.

Because the first cover member 201 has the greater length than the second cover member 202, the first cover member 201 and the second cover member 202 reach the respective opening or closing postures at different timings. Thus, it is possible to prevent the first cover member 201 and the second cover member 202 from interfering with each other when switching the postures.

Because the leaf springs 205 and 207 for urging the first and second cover members 201 and 202 toward the closing postures are provided, the cover member 203 is maintained at the closing posture when no toner cartridge 11 is accommodated in the space 12.

Next, a third embodiment of the invention will be described with reference to FIGS. 12A to 12C. In the following description, only parts differing from those of the first embodiment will be described.

Figure 12A:
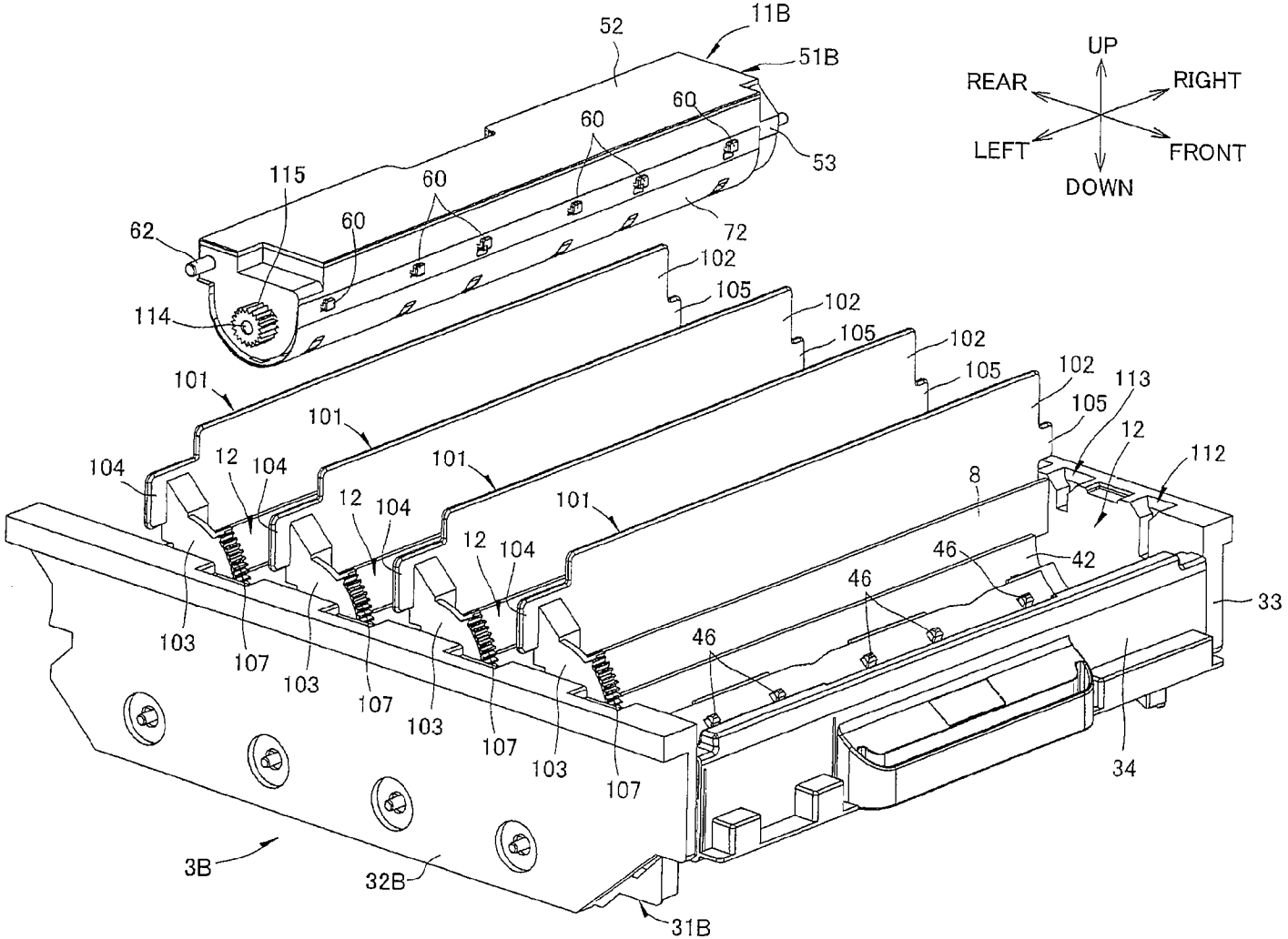
FIG. 12A is a perspective view of a drawer unit and a toner cartridge detached from the drawer unit according to a third embodiment of the invention.

As shown in FIG. 12A, a drawer frame 31B of a drawer unit 3B of this embodiment is provided with four cover members 101 instead of the cover members 47. Each cover member 101 also functions as an operation member, and integrally includes a cover main part 102 formed in a flat plate shape extending in the right-left direction and a drive gear part 103 liked to a left end section of the cover main part 102. The drive gear part 103 is formed substantially in a one-quarter circular sector shape in a side view. Each cover member 101 is disposed to be capable of switching between an opening posture in which the cover member 101 extends upward to a position above the drawer frame 31B as shown in FIGS. 12A and 12B and a closing posture in which the cover main part 102 extends along an upper edge of the drawer frame 31B.

In the following description, the cover member 101 will be described assuming that the cover member 101 is in the opening posture.

The cover main part 102 is formed in a size that can substantially entirely cover over the upper side of the space 12.

The drive gear part 103 is connected to the cover main part 102 at one radius of the circular sector shape thereof, and an arc of the circular sector shape protrudes diagonally upward and frontward. As shown in FIG. 12B, a pivot shaft 106 extending in the right-left direction is rotatably inserted through the drive gear part 103 at a position near the center of the circular sector shape. A left end of the pivot shaft 106 is immovably supported to a left side plate 32B. Through this configuration, the cover member 101 is pivotably supported to the left side plate 32B via the pivot shaft 106. The cover member 101 can switch between the opening posture and the closing posture by pivoting about the pivot shaft 106.

The drive gear part 103 is formed with gear teeth 107 on a lower half section of the arc of the circular sector shape.

Figure 12B:
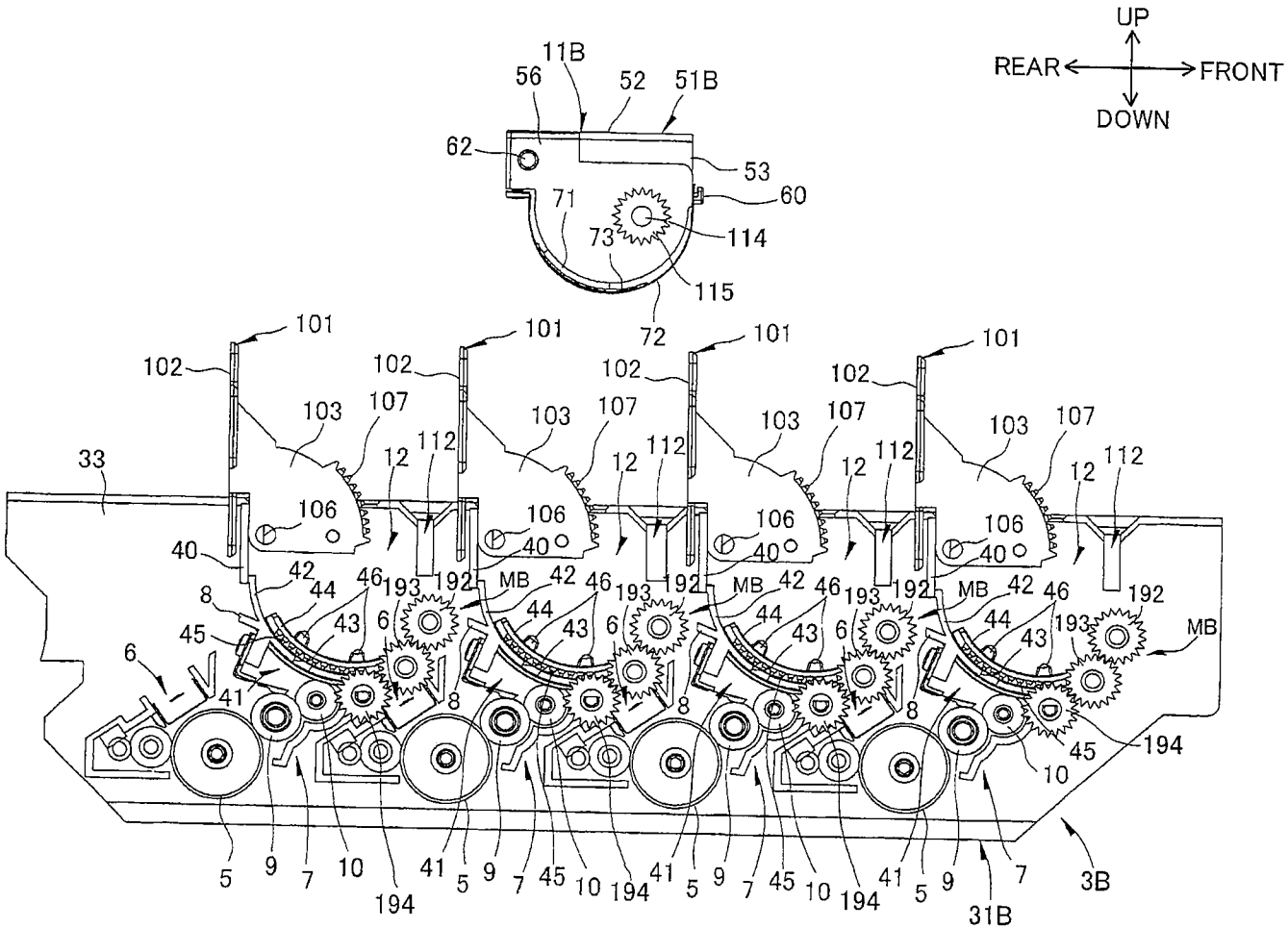
FIG. 12B is a cross-sectional right side view of the drawer unit of the toner cartridge detached from the drawer unit of FIG. 12A.
Figure 12C:
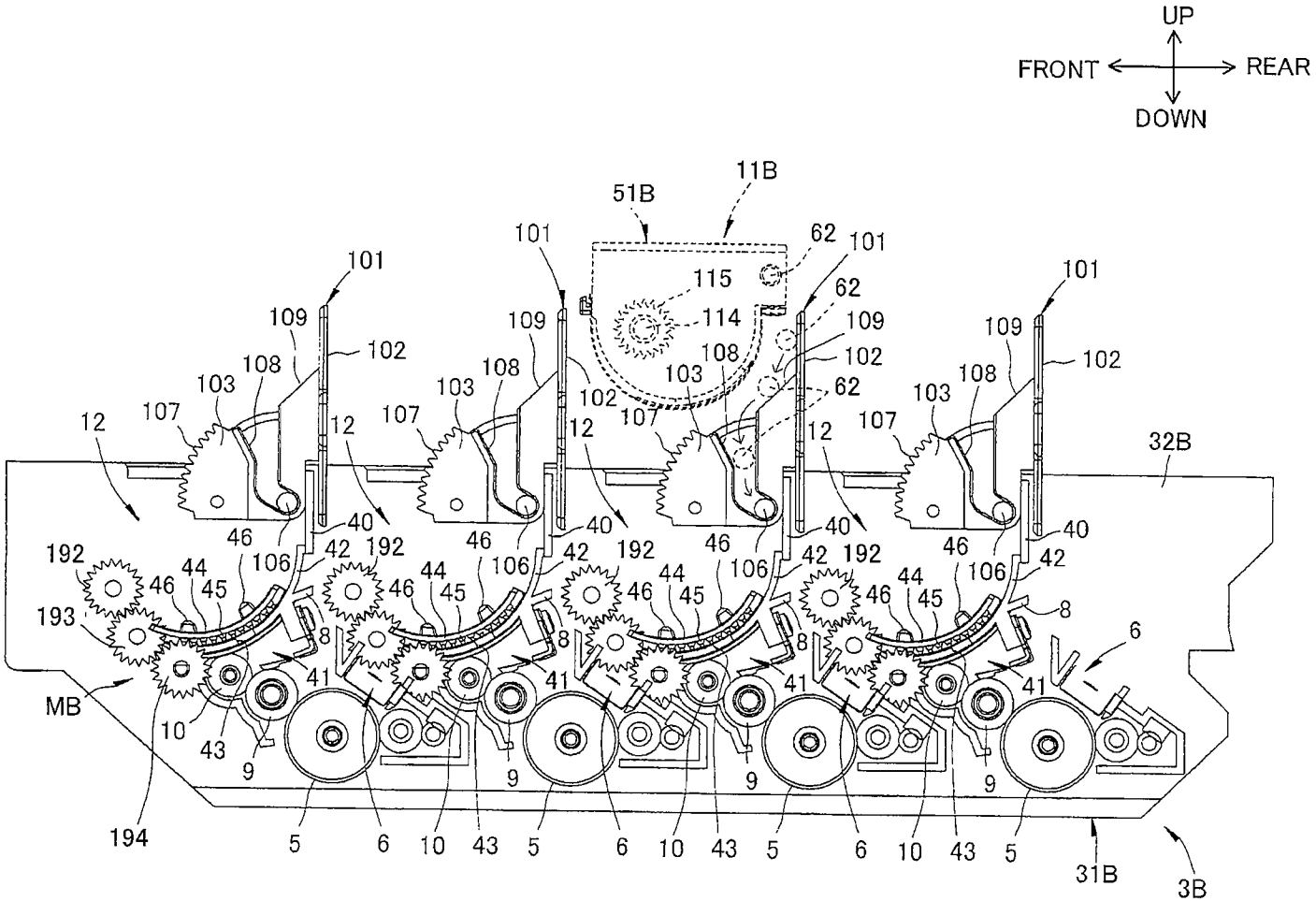
FIG. 12C is a cross-sectional right side view of the drawer unit of the toner cartridge detached from the drawer unit of FIG. 12A.

As shown in FIG. 12C, the drive gear part 103 is also formed with an open-top guide groove 108 on a right side surface (inner side surface) thereof. The guide groove 108 is open at an upper half section of the arc of the circular sector shape, extends downward from the arc, bends diagonally rearward and downward, and extends to a position that the pivot shaft 106 penetrates through. The drive gear part 103 is also formed with a sloped guide surface 109 extending diagonally upward and rearward between the upper end of the guide groove 108 and an inner surface of the cover main part 102.

As shown in FIG. 12B, the left surface 56 of a casing 51B of the toner cartridge 11B is formed with a column-shaped boss 114, instead of the guided protrusion 61 shown in FIG. 5, and the boss 114 pivotably supports a driven gear 115.

The drawer unit 3B of this embodiment does not include the operation members 37 (FIG. 4A) nor the driving force transmission mechanisms M (FIG. 6) of the first embodiment. Instead, the drawer unit 3B includes a drive mechanism (gear trains) MB shown in FIG. 12B for each toner cartridge 11B. The drive mechanism MB is disposed in the drawer frame 31B for moving the corresponding shutter 73 from the opening position to the closing position. The drive mechanism MB includes a first transmission gear 192, a second transmission gear 193, and a third transmission gear 194. The first transmission gear 192 meshingly engages with the driven gear 115 of the toner cartridge 11B accommodated in the space 12. The second transmission gear 193 is in meshing engagement with the first transmission gear 192. The third transmission gear 194 is in meshing engagement with both the second transmission gear 193 and the rack gear 45. The first, second, and third right pinion gears 192, 193, and 194 are rotatably supported on the left side plate 32B of the drawer frame 31B.

When rotates, the driven gear 115 supplies rotative force to the first transmission gear 192, thereby rotating the first transmission gear 192. The rotative force supplied to the first transmission gear 192 is transmitted through the second transmission gear 193 and the third transmission gear 194 to the rack gear 45. As a result, the shutter driving member 44 moves in the front-rear direction along the partitioning wall 42, and the shutter 73 moves integrally with the shutter driving member 44 between the opening position and the closing position.

In order to accommodate the toner cartridge 11B into the space 12, first the corresponding cover member 101 is switched to the opening posture as shown in FIGS. 12A to 12C, and then the toner cartridge 11B is lowered from a position above the space 12 toward the space 12. At this time, the guided protrusion 62 formed on the left surface 56 of the casing 51B is guided by the inner surface of the cover main part 102 and the sloped guide surface 109 into the guide groove 108 of the cover member 101, as indicated by dotted chain lines in FIG. 12C. When the guided protrusion 62 reaches the deepest position in the guide groove 108, the toner cartridge 11B is completely accommodated in the space 12 and supported by the drawer frame 31B.

In this condition, the shutter-driving protrusions 46 penetrate through the guide openings 85 (FIG. 5) and engage with the shutter driving openings 88, thereby linking the shutter driving member 44 to the shutter 73. Also, the driven gear 115 of the toner cartridge 11B is in meshing engagement with the first transmission gear 192. However, the gear teeth 107 are located above the driven gear 115 and out of engagement with the driven gear 115.

Then, the cover member 101 is brought to the closing posture. As the cover member 101 shifts toward the closing posture, the gear teeth 107 move in a clockwise direction in a left side view. During this movement of the gear teeth 107, the gear teeth 107 meshingly engage with the driven gear 115 and then rotate the driven gear 115 in a counterclockwise direction in a left side view. The rotation of the driven gear 115 generates rotative force, which is then transmitted through the first transmission gear 192 and the second transmission gear 193 to the third transmission gear 194, rotating the third transmission gear 194 in a clockwise direction in a left side view. The clockwise rotation of the third transmission gear 194 moves the shutter driving member 44 frontward from the position at which the shutter driving member 44 opposes the openings 43 to the position at which the shutter driving member 44 does not oppose the openings 43. At this time, the shutter 73 moves frontward integrally with the shutter driving member 44 from the closing position to the opening position.

When the cover member 101 is moved from the closing posture to the opening posture, on the other hand, the shutter 73 is moved from the opening position to the closing position in a reverse procedure to the attachment of the toner cartridge 11.

Because the cover member 101 functions as an operation member that is operated to move the shutter 73 between the opening position and the closing position, it is unnecessary to provide an operation member separate from the cover member 101, reducing the number of components of the color printer and simplifying the configuration thereof.

While the invention has been described in detail with reference to the embodiments thereof, it would be apparent to those skilled in the art that various changes and modifications may be made therein without departing from the spirit of the invention.

Because the toner cartridges 11 for different colors (or different types) are accommodated in the spaces 12, a configuration may be adopted for preventing a toner cartridge 11 from being erroneously accommodated into a space 12 other than a corresponding space 12.

Figure 13:
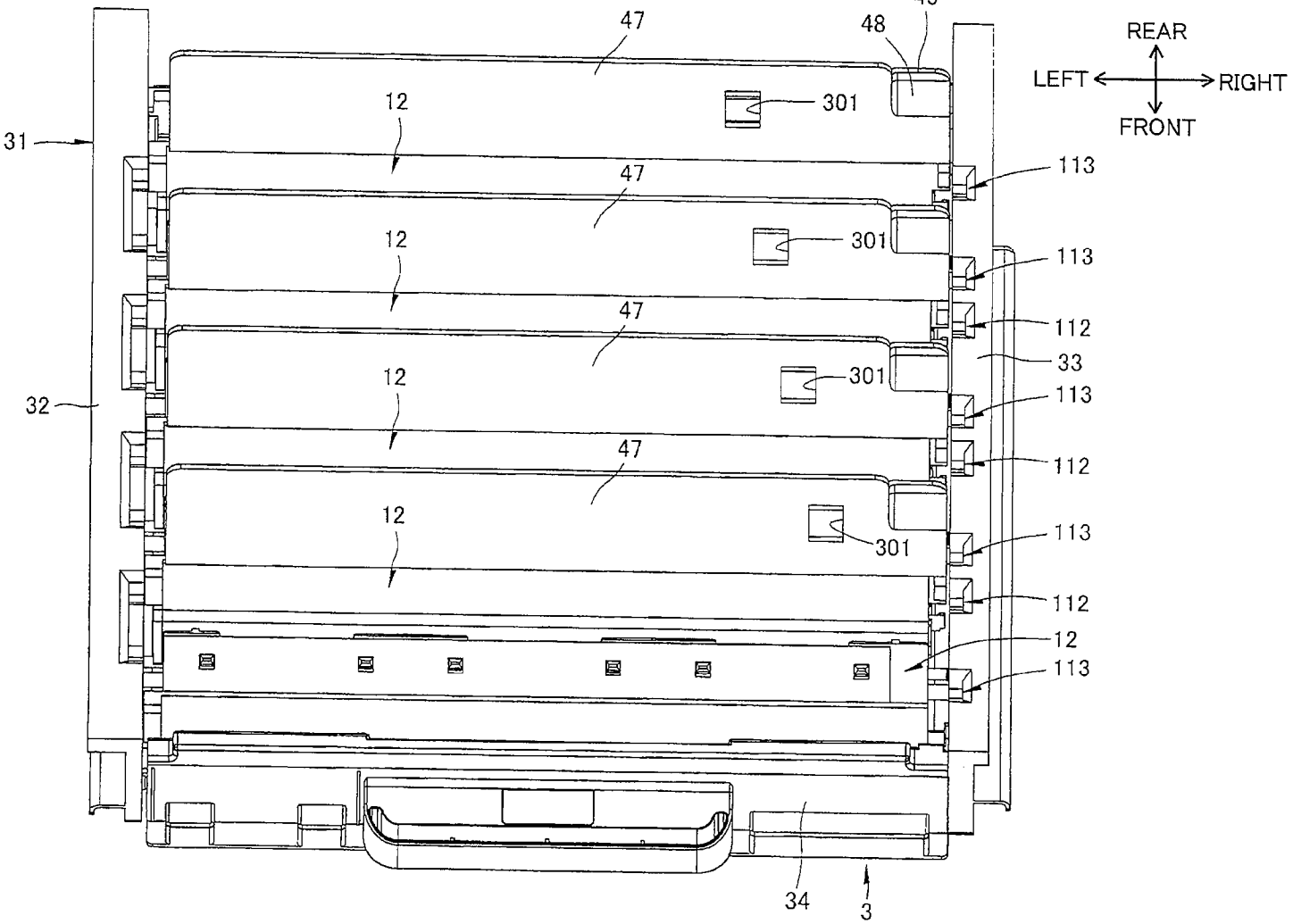
FIG. 13 is a plan view of a drawer unit according to a modification of the embodiments with cover members in opening postures.
Figure 14:
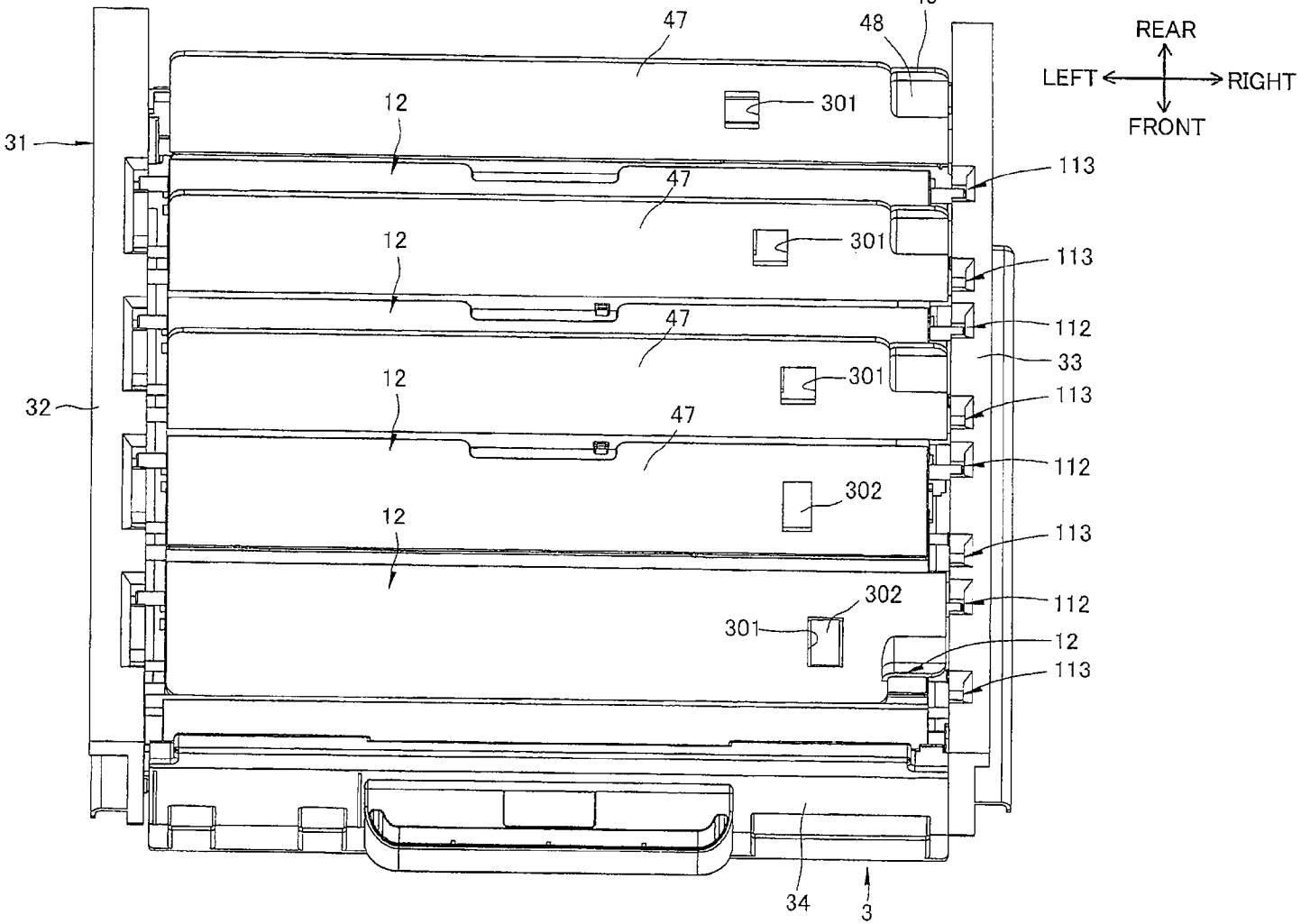
FIG. 14 is a plan view of the drawer unit of FIG. 13 with the toner cartridge accommodated in the drawer unit and one cover member in a closing posture.
Figure 15A:
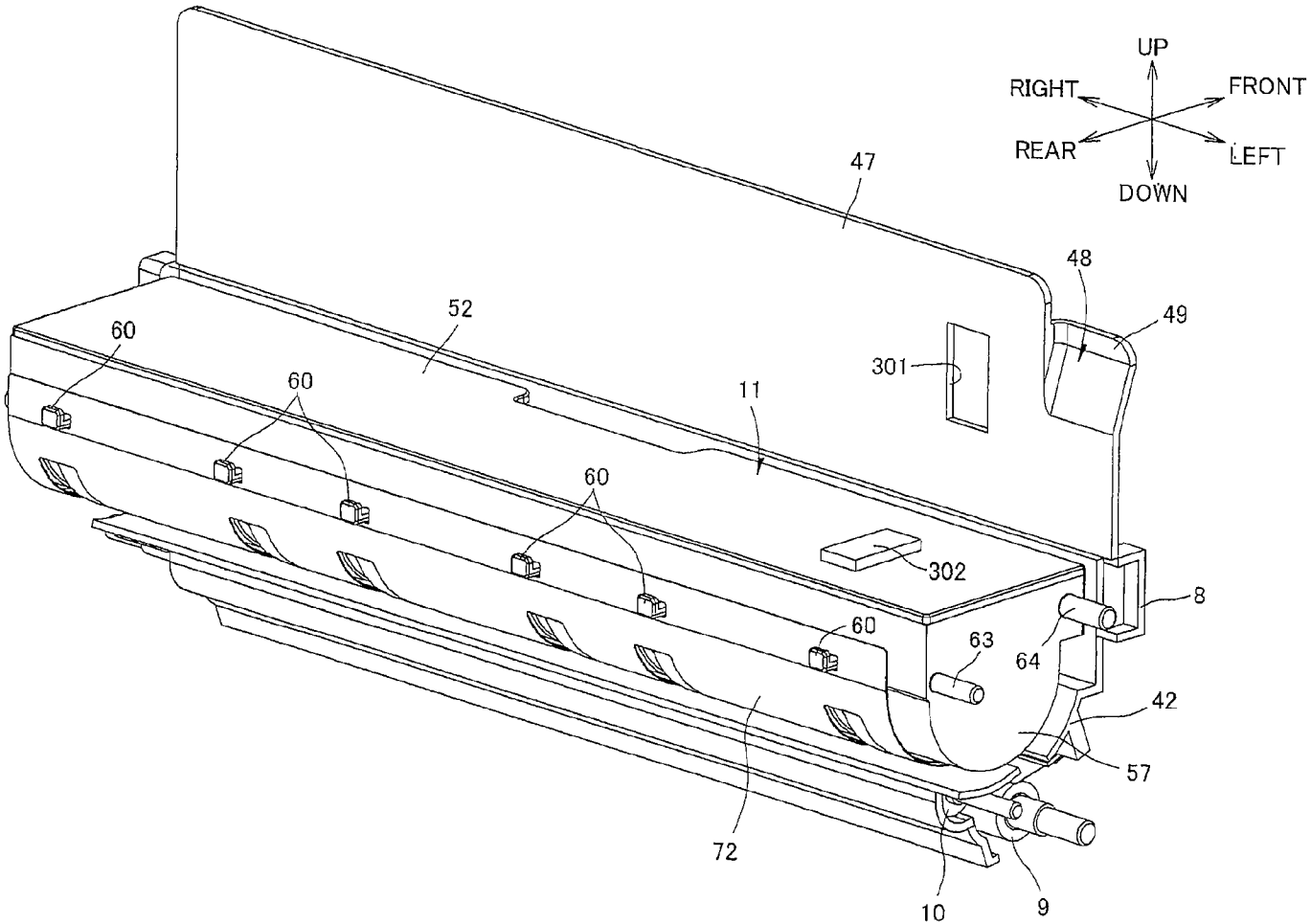
FIG. 15A is a perspective partial view of the drawer unit of FIG. 14, with a toner cartridge accommodated in a correct space in the drawer unit and with the cover member in the opening posture.

For example, as shown in FIG. 13, the cover members 47 may be formed with respective rectangular openings 301 at shifted positions in the right-left direction, and, as shown in FIGS. 14 and 15A, each toner cartridge 11 may be formed on the upper surface 52 of the casing 51 with a rectangular protrusion 302 having a size that can engage with the corresponding opening 301.

Figure 15B:
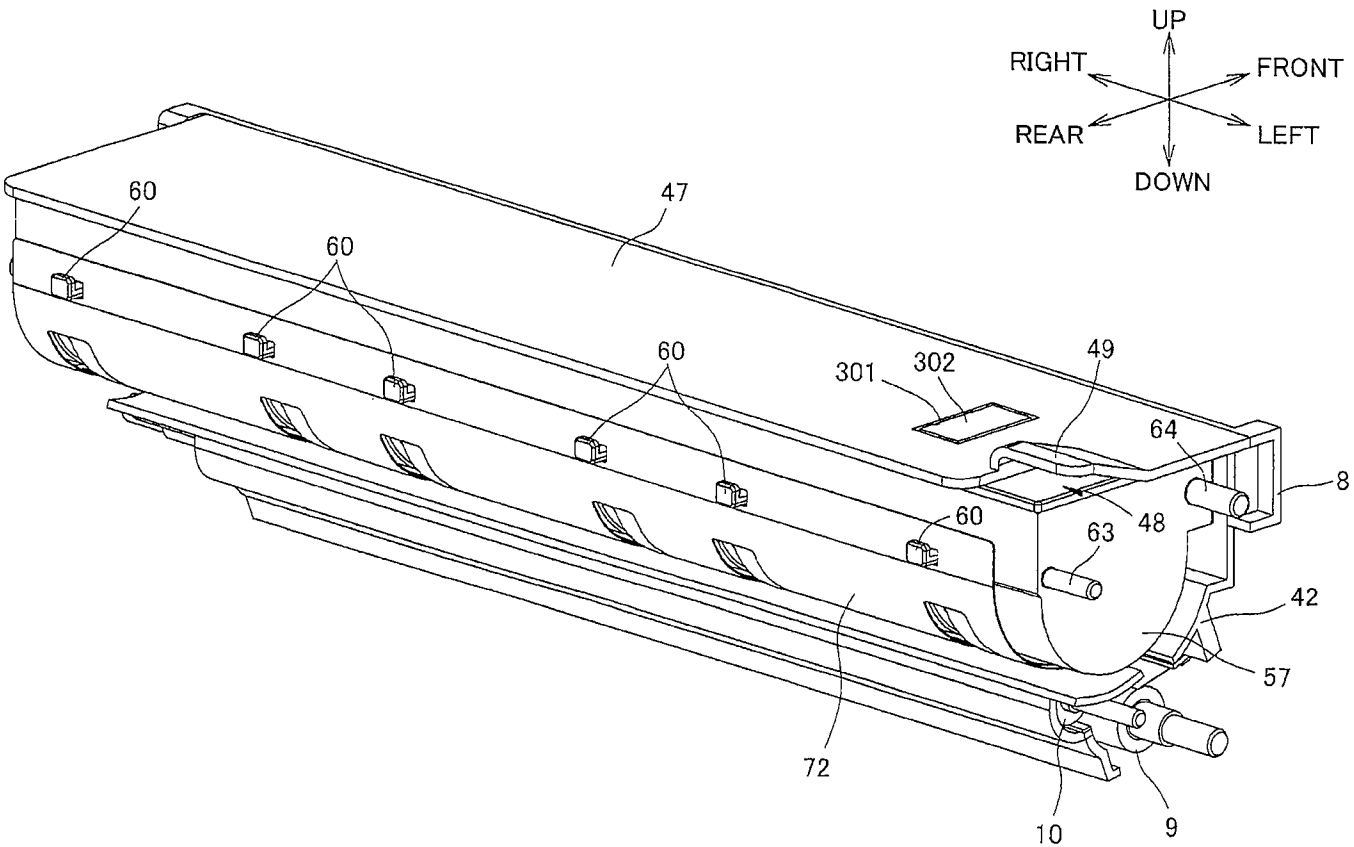
FIG. 15B is a perspective partial view of the drawer unit of FIG. 14, with the toner cartridge accommodated in the correct space in the drawer unit and with the cover member in the closing posture.
Figure 16A:
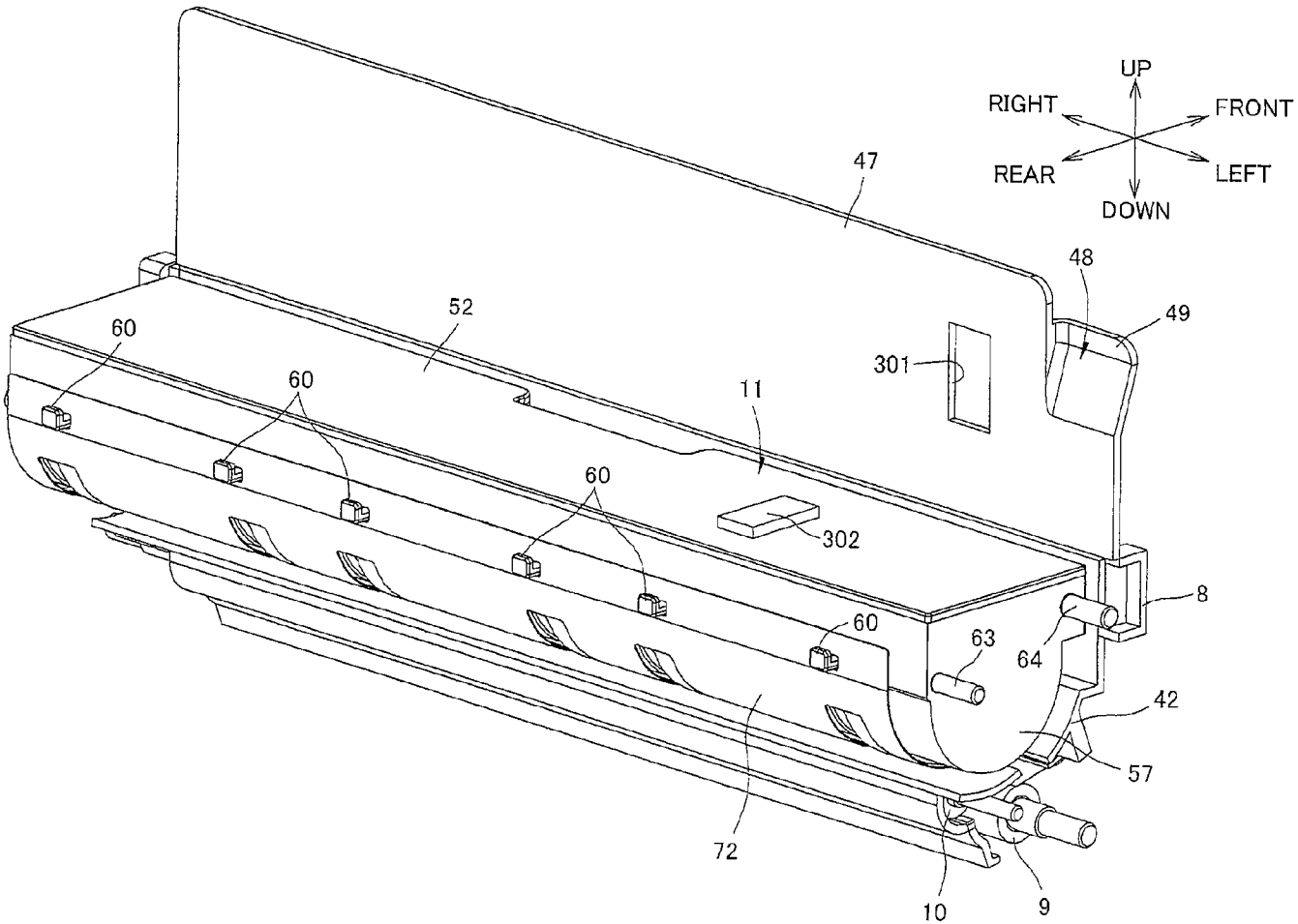
FIG. 16A is a perspective partial view of the drawer unit of FIG. 14, with a toner cartridge accommodated in a wrong space in the drawer unit, making it impossible to shift the cover member to the opening posture.
Figure 16B:
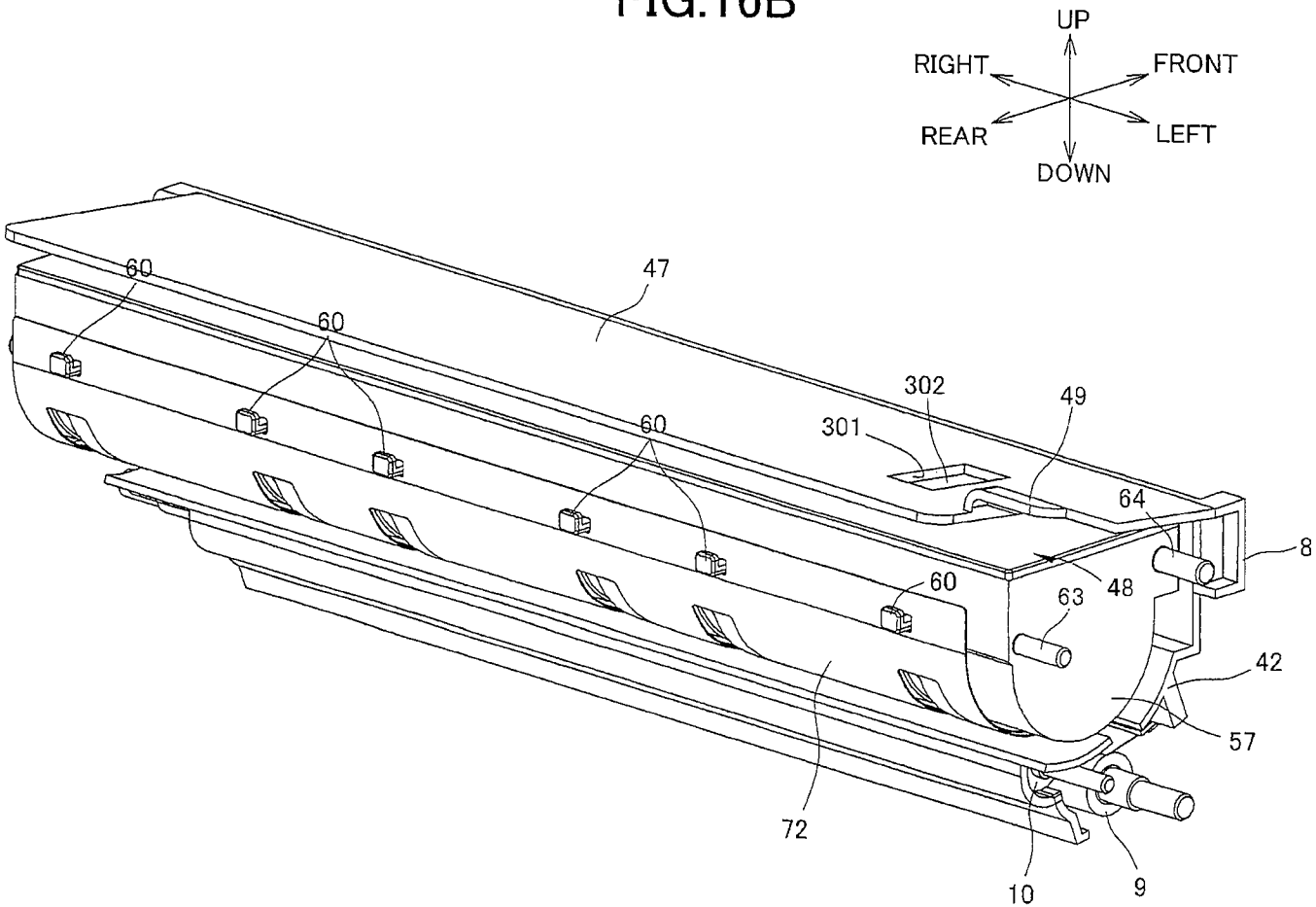
FIG. 16B is a perspective partial view of the drawer unit of FIG. 14, with a toner cartridge accommodated in a wrong space in the drawer unit, making it impossible to shift the cover member to the closing posture.

When the toner cartridge 11 is accommodated into the corresponding space 12 as shown in FIG. 15A, then the protrusion 302 engages with the opening 301 when the cover member 47 is shifted toward the closing posture, allowing the cover member 47 to reach the closing posture, as shown in FIG. 15B. When the toner cartridge 11 accommodated into the space 12 is not corresponding to this space 12 (when the toner cartridge 11 for a wrong color is accommodated into the space 12) as shown in FIG. 16A, on the other hand, then the protrusion 302 does not engage with the protrusion 302 as shown in FIG. 16B when the cover member 47 is shifted toward the closing posture. Thus, the cover member 47 cannot reach the closing posture.

With this configuration, it is possible to prevent erroneous attachment of the toner cartridge 11 into the space 12. In this configuration, the opening 301 and the protrusion 302 together function as erroneous-attachment preventing member.

Also, this configuration enables a user to discern the color of the toner cartridge 11 to be accommodated into the space 12 corresponding to each cover member 47 based on the position of the opening 301 formed in the cover member 47. In other words, the position of the opening 301 functions as an indicator that indicates the color of the toner cartridge 11 to be accommodated into the space 12 corresponding to the cover member 47. This further reliably prevents erroneous attachment of the toner cartridge 11.

What is claimed is:

1. An image forming device comprising:

a main casing;

a support member movable between an accommodated position within the main casing and a pulled-out position outside the main casing, the support member being formed with a plurality of cartridge accommodating sections, each of the cartridge accommodating sections having a first side and a second side on a downstream side of the first side with respect to a direction;

a plurality of developing units supported on the support member and corresponding to the plurality of cartridge accommodating sections;

a plurality of toner cartridges, each accommodated in a corresponding cartridge accommodating section so as to be detachable from the corresponding cartridge accommodating section when the support member is located at the pulled-out position, and each including a casing and a shutter, wherein:

the casing accommodates toner therein and is formed with an opening for supplying the toner to the corresponding developing unit;

the opening faces in the direction in a condition that the toner cartridge is accommodated in the corresponding cartridge accommodating section; and the shutter is movable between an opening position at which the shutter exposes the opening and a closing position at which the shutter closes the opening; and wherein the support member has a cover member that is movable between an opening posture in which the cover member exposes the first side of the corresponding cartridge accommodating section and a closing posture in which the cover member opposes the first side of the corresponding cartridge accommodating section;

wherein the cover member has a base end and a free end; and wherein the cover member is configured such that the free end of the cover member moves in the direction when the cover member moves from the closing posture to the opening posture.

2. The image forming device according to claim 1, wherein the cover member is provided with a judging section enabling a user to discern whether any toner cartridge is accommodated in the corresponding cartridge accommodating section.

3. The image forming device according to claim 1, wherein the support member is provided with an operation member that is operated to move the shutter of each toner cartridge between the opening position and the closing position.

4. The image forming device according to claim 3, wherein the cover member functions as the operation member.

5. The image forming device according to claim 1, wherein the cover member moves from the closing posture to the opening posture as the toner cartridge is accommodated into the corresponding cartridge accommodating section, and the cover member in the opening posture opposes the toner cartridge in a predetermined direction perpendicular to the direction within the corresponding cartridge accommodating section.

6. The image forming device according to claim 5, wherein the cover member is divided into a first cover member on one side and a second cover member on another side with respect to the predetermined direction in which the cartridge accommodating sections are juxtaposed with one another.

7. The image forming device according to claim 6, wherein the first cover member has a greater length than the second cover member with respect to the predetermined direction.

8. The image forming device according to claim 5, further comprising an urging member for urging the cover member toward the closing posture.

9. The image forming device according to claim 5, further comprising an operation member that is operated to move the shutter of each toner cartridge between the opening position and the closing position.

10. The image forming device according to claim 1, wherein:

each of the toner cartridges is of a different type; and a plurality of cover members is provided in correspondence with the plurality of cartridge accommodating sections, wherein each of the cover members is provided with a preventing unit that prevents any of the toner cartridges different from a type corresponding to one of the cartridge accommodating sections from being accommodated into the one of the cartridge accommodating sections.

11. The image forming device according to claim 1, wherein:

each of the toner cartridges is of a different type; and the cover member is one of a plurality of cover members, the plurality of cover members being provided in correspondence with the plurality of cartridge accommodating sections, wherein each of the cover members is provided with an indicating unit that indicates one of the toner cartridges to be accommodated in the corresponding cartridge accommodating section.

* * * * *